US005584247A

United States Patent [19]

Almaraz et al.

[11] Patent Number: 5,584,247

[45] Date of Patent: Dec. 17, 1996

[54] RAIL CLIP APPLICATOR

[75] Inventors: Roberto Almaraz; David Gustin, both of Racine; Leroy D. Wilson, Milwaukee, all of Wis.

[73] Assignee: Racine Railroad Products, Inc., Racine, Wis.

[21] Appl. No.: 500,738

[22] Filed: Jul. 11, 1995

Related U.S. Application Data

[63] Continuation-in-part of Ser. No. 188,963, Jan. 27, 1994, Pat. No. 5,431,107.

[51] Int. Cl.[6] ..... E01B 29/24

[52] U.S. Cl. ..... 104/2; 104/172; 221/298

[58] Field of Search ..... 104/2, 9, 16, 17.1, 104/17.2, 307; 221/298

[56] References Cited

U.S. PATENT DOCUMENTS

| | | | |
|---|---|---|---|
| 4,068,593 | 1/1978 | Leeves | 104/307 |
| 4,320,707 | 3/1982 | McIlrath | 104/122 |
| 4,479,440 | 10/1984 | Burr et al. | 104/17.2 |
| 4,580,338 | 4/1986 | Badger | 29/759 |
| 4,609,387 | 6/1987 | Casarini et al. | 104/17.2 |
| 4,733,614 | 3/1988 | Mohr et al. | 104/7.1 |
| 5,165,346 | 11/1992 | Piekarski | 104/17.2 |
| 5,191,838 | 3/1993 | Hansen | 104/2 |
| 5,269,225 | 12/1993 | Bosshart et al. | 104/2 |
| 5,431,107 | 7/1995 | Almarez et al. | 104/2 |
| 5,458,065 | 10/1995 | Catlliau et al. | 104/2 |

FOREIGN PATENT DOCUMENTS

| | | | |
|---|---|---|---|
| 1509900 | 9/1974 | United Kingdom | 29/24 |

OTHER PUBLICATIONS

Railway Gazzette International, Apr. 1976, one page.

Railway Gazzette International, Nov. 1978, one page.

*Primary Examiner*—S. Joseph Morano

*Attorney, Agent, or Firm*—Nilles & Nilles, S.C.

[57] ABSTRACT

A clip applicator machine is capable of automatically separating individual spring-type rail clips from a stack of clips and of applying the individual clips in anchor sockets such that they are fully tensioned against the base of the rail. The clip applicator machine may include two separate workheads 1) each of which is positioned over a respective rail and 2) each of which may support gauge and field side clip applicator assemblies operable to apply clips on the respective sides of the associated rail. Each applicator assembly is movable from a position in which it receives clips one at a time from a magazine, through a position in which it is aligned with the anchor socket of tie plate, and into a clip applying position. A backstop is associated with each clip applicator assembly for aligning the workhead longitudinally with respect to the rail and anchor socket and for holding the tie plate in position during the clip application process, and a clamp assembly is provided which clamps the workhead to the rail while aligning it transversely with respect to the rail and anchor socket. Preferably, the entire workhead is mounted on a float frame for vertical movement with respect to the rail and for movement both longitudinally and transversely with respect to the rail. Finally, a novel magazine assembly is provided for facilitating the feeding of clips to the clip applicator assembly.

34 Claims, 32 Drawing Sheets

RAIL CLIP APPLICATOR

CROSS-REFERENCE TO RELATED APPLICATION

The present application is a continuation-in-part of U.S. patent application Ser. No. 188,963, filed Jan. 27, 1994, now U.S. Pat. No. 5,431,107.

BACKGROUND OF THE INVENTION

1. Field of the Invention

The invention relates to a method and apparatus for laying and maintaining railways and, more particularly, relates to a method and apparatus for applying spring clips in anchor sockets.

2. Description of the Related Art

The use of spring clips to fasten rails to concrete or wooden ties is becoming increasingly popular. The clip most commonly employed is manufactured by Pandrol Incorporated of Bridgeport, N.J. and is formed from a steel bar bent generally into the form of an "e". Such a clip, commonly known in the art as a "Pandrol e" clip, is used to fasten a rail to an anchor socket imbedded in a concrete or wooden tie by first loosely setting a center leg of the clip in the socket such that a toe of the clip loops back onto the base of the rail, and by then applying the clip by driving the clip further into the socket such that the clip applies substantial spring forces to the base of the rail.

The steps of setting and applying rail clips typically are performed independently of one another and have traditionally been performed manually with a first work gang manually setting the clips in the sockets and a second work gang driving the clips further into the sockets with sledge hammers. More recently, machines have been constructed which automatically apply clips after they have been manually set in the sockets. One such machine is disclosed in U.S. Pat. No. 4,320,707 to McIlrath (the McIlrath patent). The McIlrath patent discloses a clip applicator having arms which are mounted on a workhead and which can be hydraulically actuated to drive pincers into contact with a previously set clip to forcefully drive the clip into the socket, thereby applying the clip. While the clip applying machine disclosed by the McIlrath patent operates well, it still requires that clips be set in the sockets prior to application. This clip setting has heretofore been performed manually and thus is labor intensive.

Another machine, disclosed in U.S. Pat. No. 5,191,838 to Hansen (the Hansen patent), is designed to set and apply clips using a single machine. The machine disclosed by the Hansen patent includes a magazine, a clip shuttle which transfers clips from the magazine into alignment with anchor sockets, and a drive block which drives clips from the clip shuttles into the anchor sockets with sufficient force to apply the clips.

The machine disclosed by Hansen, though capable of applying clips which have not been previously set, exhibits several drawbacks and disadvantages. For instance, because the clip shuttle and drive block and associated components must be operated independently of one another yet must be capable of cooperating with one another at critical times, the machine disclosed by the Hansen patent is relatively large and complex. It also may be cost prohibitive to some customers, particularly those who already own a clip applicator and merely require a less labor intensive technique for setting clips.

Alignment of the machine disclosed in Hansen both longitudinally and transversely with respect to the rail and socket is relatively difficult and requires the operation of drive cylinders operable independently of rail clamps, stops, and other portions of the workhead.

OBJECTS AND SUMMARY OF THE INVENTION

It is therefore an object of the invention to provide an apparatus which is relatively simple in construction and operation but yet which is capable of at least setting clips in the sockets of tie plates for application.

In accordance with a first aspect of the invention, this and other aspects were achieved by providing a clip setter as disclosed and claimed in U.S. Pat. No. 5,431,107, priority on which is claimed in the present application.

Another object of the invention is to provide a clip applicator having at least some of the advantageous characteristics of simplicity and compactness present in the clip setter as described above.

Another object of the invention is to provide a clip applicator having the characteristics described above and which does not require a separate clip shuttle and drive block to apply clips.

In accordance with a first aspect of the invention, these objects are achieved by providing a clip applicator including a magazine assembly which stores the clip in a stack, a clip applying tool, and a drive assembly. The drive assembly drives the clip applying tool from a first position in which the clip applying tool receives the clip from the magazine assembly, through a second position in which the clip applying tool positions the clip adjacent the socket, and into a third position in which the clip applying tool drives the clip far enough into the socket to fully tension the clip against a base of the rail.

Still another object of the invention is to provide a clip applicator which has one or more of the characteristics described above and which automatically aligns itself both longitudinally and transversely with respect to the rail and socket upon actuation.

In accordance with another aspect of the invention, this object is achieved by providing a lift mechanism including an upper, support frame mounted on the chassis and a lower float frame. The support frame includes (1) an outer frame mounted on the vehicle chassis and (2) an inner frame which is mounted on the outer frame and which is movable fore-to-aft with respect to the outer frame and the rail. A portion of the float frame is movable from side-to-side with respect to the remainder of the float frame and the rail.

Still another object of the invention is to provide a novel clip applying tool for a clip applicator having one or more of the characteristics discussed above.

In accordance with another aspect of the invention, this object is achieved by providing a clip holder and a clip driver. The clip holder has a pocket formed therein for receiving the clip, and the clip driver slidably receives the clip holder so as to be movable relative to the clip holder through a designated linear stroke. The clip driver includes a ram which extends into the pocket and which is operable to drive the clip out of the clip holder and to apply the clip when the clip driver traverses the designated linear stroke.

Yet another aspect of the invention is to provide a novel backstop for a clip applicator having one or more of the characteristics discussed above.

In accordance with yet another aspect of the invention, this object is achieved by providing a housing having a pair of sidewalls each having at least one cam device formed therein. A backstop arm is mounted in the housing by the cam device and has a downwardly-depending front end for selectively engaging the tie plate. A drive device (preferably a double acting hydraulic cylinder) is connected to the backstop arm and selectively drives the backstop arm to move along the cam grooves from a first position in which the front end of the backstop arm is located above and behind the tie plate to a second position in which the front end of the backstop arm engages the tie plate. Preferably, the cam device comprises (1) cam grooves formed in the sidewalls of the housing and (2) cam rollers mounted on the backstop arm and riding in the cam grooves.

Yet another object of the invention is to provide a novel magazine assembly for a clip applicator having one or more of the characteristics discussed above.

In accordance with another aspect of the invention, this object is achieved by providing a magazine which stores a stack of the clips and first and second latch block assemblies disposed opposite one another on the magazine. Each of the first and second latch block assemblies include first and second latch blocks. The first latch block of each assembly is movable (1) from a first position in which it is inserted between a bottom clip in the stack and the remainder of the stack and in which it supports the remainder of the stack (2) to a second position in which it is withdrawn from the stack and in which the remainder of the stack rests on the bottom clip. The second latch block of each assembly is movable (1) from a first position in which it is inserted beneath the stack and in which it supports the bottom clip (2) to a second position in which it is withdrawn from the stack and leaves the bottom clip unsupported.

Still another object of the invention is to provide a relatively simple method of automatically applying a rail clip in an anchor socket.

In accordance with yet another aspect of the invention, this object is achieved by feeding the clip from a magazine assembly to a clip applying tool, moving the clip applying tool and the clip as a unit into horizontal alignment with the socket, and then moving the clip applying tool toward the socket so as to first set the clip into the socket and then fully tension the clip onto a base of the rail.

Yet another object of the invention is to provide a method which has one or more of the characteristics discussed above and which also automatically aligns the workhead on which the components of the clip applicator are mounted with the anchor socket.

In accordance with yet another aspect of the invention, this object is achieved by engaging the rail with clamps thereby to clamp the workhead to the rail and to move the workhead and at least a portion of the frame transversely with respect to the rail to a position in which the clip applying tool is in latitudinal alignment with the socket, and lowering a backstop into engagement with the tie plate thereby to hold the tie plate in position and to move the workhead and the frame longitudinally with respect to the rail to a position in which the clip applying tool is properly positioned to apply the clip.

Other objects, features, and advantages of the present invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout and in which.

DETAILED DESCRIPTION OF THE PREFERRED EMBODIMENTS

I. Resume

Figure 1:
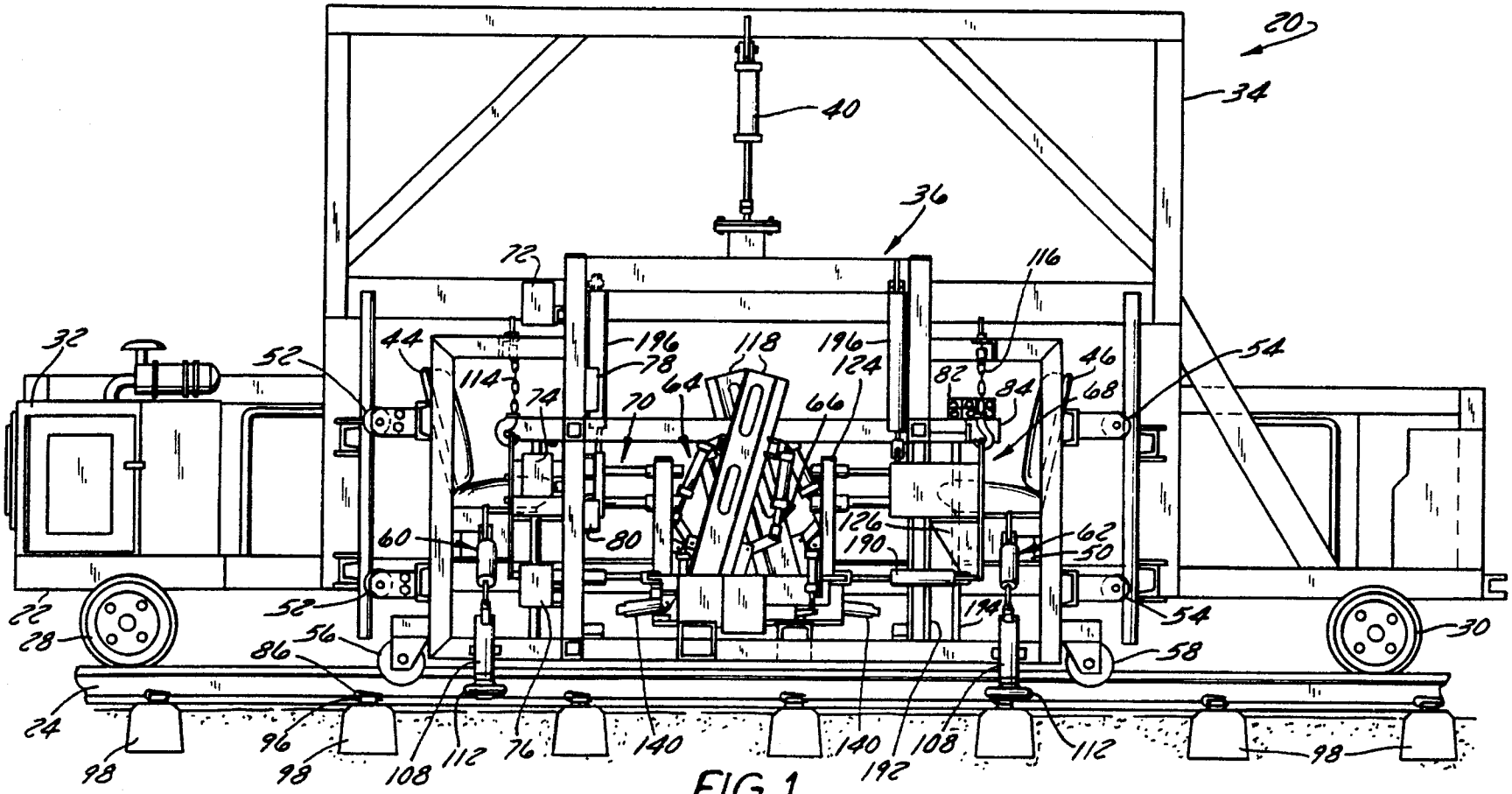
FIG. 1 is a side elevation view of a clip setting machine incorporating some of the beneficial characteristics of the present invention.
Figure 2:
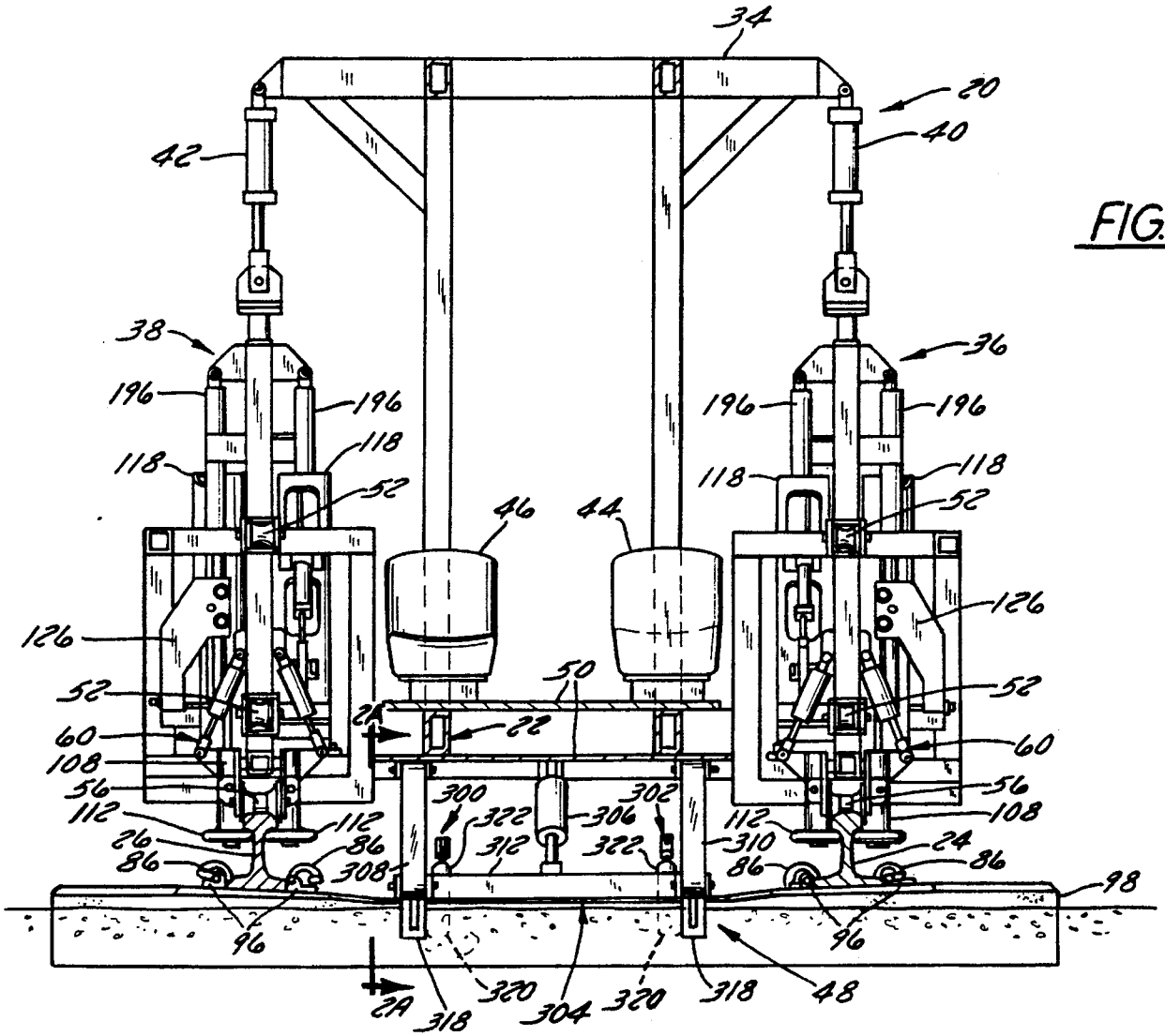
FIG. 2 is an end elevation view of the clip setting machine of FIG. 1.
Figure 2A:
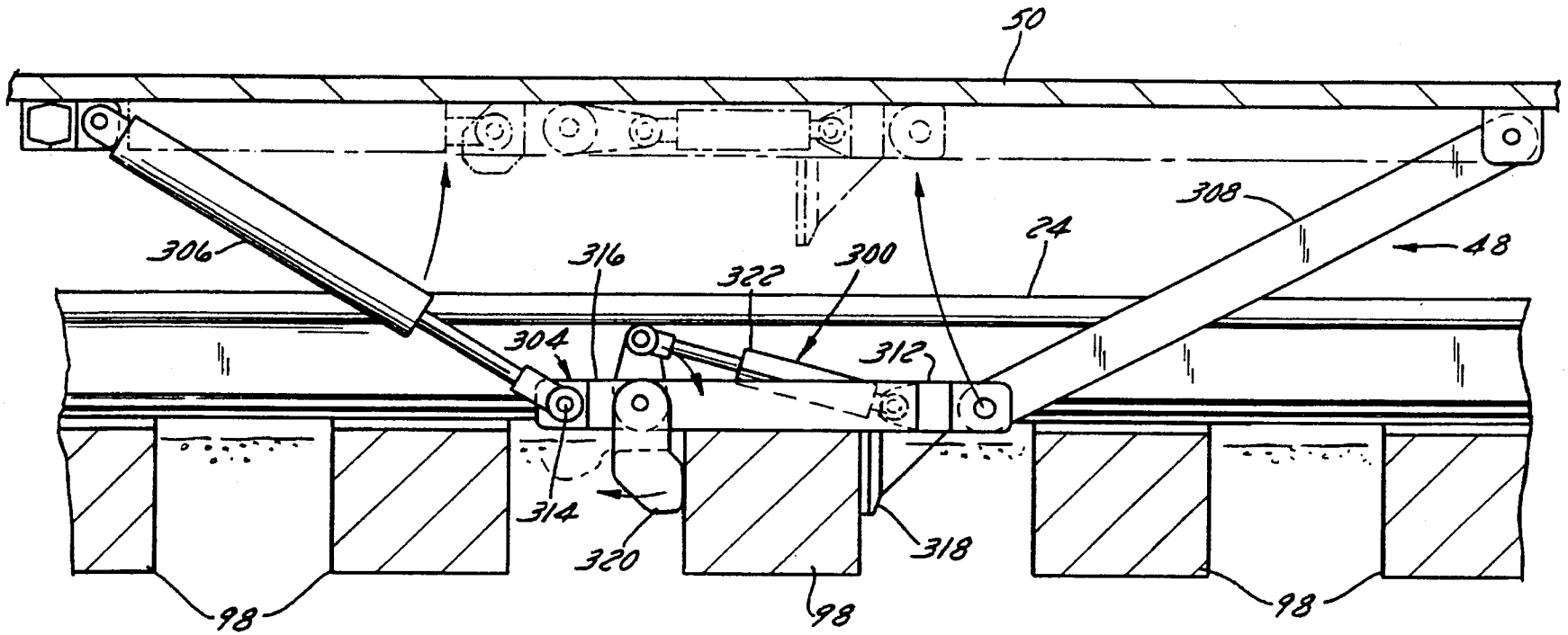
FIG. 2A is a sectional view taken along the lines 2A—2A in FIG. 2.

Pursuant to the invention, a clip applicator machine is provided which is capable of automatically separating individual spring-type rail clips from a stack of clips and of applying the individual clips in anchor sockets such that they are fully tensioned against the base of the rail. The clip applicator machine may include two separate workheads 1) each of which is positioned over a respective rail and 2) each of which may support gauge and field side clip applicator assemblies operable to apply clips on the respective sides of the associated rail. Each clip applicator assembly is movable from a position in which it receives clips one at a time from a magazine, through a position in which it is aligned with the anchor socket of a tie plate, and into a clip applying position. A backstop is associated with each clip applicator assembly for aligning the workhead longitudinally with respect to the rail and anchor socket and for holding the tie plate in position during the clip application process, and a clamp assembly is provided which clamps the workhead to the rail while aligning it transversely with respect to the rail and anchor socket. Preferably, the entire workhead is mounted on a float frame for vertical movement with respect to the rail and for movement both longitudinally and transversely with respect to the rail. Finally, a novel magazine assembly is provided for facilitating the feeding of clips to the clip applicator assembly.

II. Clip Setting Machine

A. System Overview

Referring now to FIGS. 1–4, a clip setting machine 20 incorporating some of the beneficial aspects of the present invention includes a self-propelled chassis 22 which is movably supported on rails 24, 26 by front and rear wheels 28, 30 and which is driven by hydraulic motors (not shown) which are in turn driven by and mounted to an engine 32. The chassis 22 presents a frame 34 having first and second workheads 36, 38 suspended therefrom by respective hydraulic lift cylinders 40, 42. Seats 44, 46 are supported on the frame 34 between the workheads 36, 38 to provide work stations for the operators. A tie alignment assembly 48 is suspended from a central portion 50 of the frame 34. Also mounted on each of the workheads are first, second, and third solenoid operated pneumatic vanes 72, 74, 76, a pair of air manifolds 78, 80, and a hydraulic valve block 82 and an associated manifold 84.

Each of the workheads 36, 38 is of identical construction and is guided for vertical movement on the frame 34 by front and rear guide rollers 52, 54 and is guided for horizontal movement along the rails 24, 26 by front and rear railhead guide wheels 56, 58. Each workhead 36, 38 also receives front and rear clamp assemblies 60, 62 ("front" and "rear" as used herein denote the front of the machine 20, not the front of a particular workhead), field and gauge side clip dispensing assemblies 64, 66, and corresponding field and gauge side clip setter assemblies 68, 70.

Figure 5:
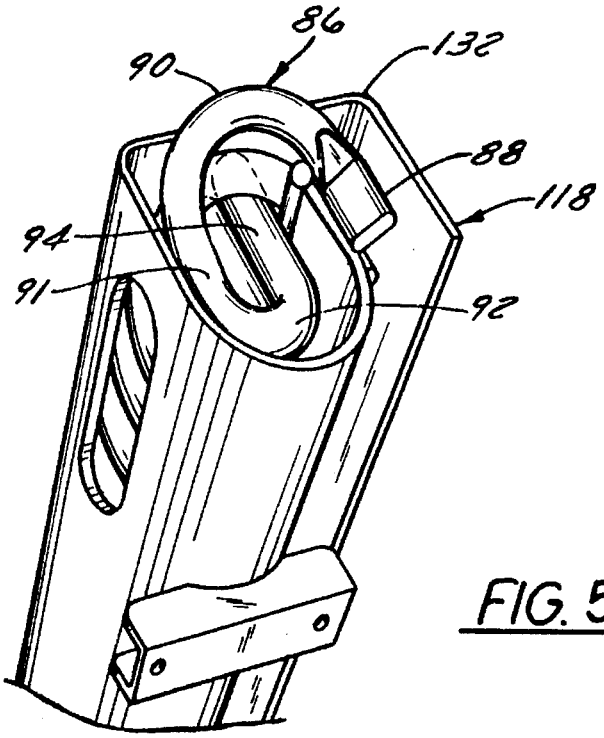
FIG. 5 is a perspective view of the upper portion of a magazine of the clip setting machine of FIGS. 1–4.

The clip setting machine 20 may be adapted to set virtually any spring-type rail clip in a socket to prepare the clip for subsequent application. One typical clip 86, known as a Pandrol e clip of the type discussed above and illustrated in some detail in FIGS. 5–7, takes the form of a generally cylindrical rod bent into a shape having a first free end portion 88 forming a toe, an outwardly curved front arch 90, a heel 91, a rearwardly curving rear arch 92, and a second free end portion forming a center leg 94 disposed generally between the toe 88 and the heel 91. The clips 86 are designed to attach the rails 24, 26 with tie socket 96 using spring forces. The sockets 96 are embedded in wooden or concrete ties 98 in a conventional manner. In its applied position, the heel 91 of each clip 86 rests upon a ledge 100 formed on the outer extent of a socket 102 of each tie socket 96 (FIG. 7), and the toe 88 extends inwardly over an insulator (not shown) resting on the base of the rail 24, 26. Substantial spring forces are applied to the base of the rail through the insulator by the toe 88 when the center leg 94 is driven into the tie socket 96 during the application process.

The tie alignment assembly 48 is designed to align the ties 98 with the workheads 36, 38 prior to a clip setting operation. Tie alignment is possible because ties 98 are usually only loosely set in the surrounding ballast when the rails 24, 26 are being laid. In fact, some or all of the ballast is often absent during rail laying. The ties 98 are thus free to move significantly with respect to the surrounding ballast. The tie alignment assembly 48 is designed to take advantage of this phenomenon.

The tie alignment assembly 48 comprises a pair of opposed tie locator assemblies 300, 302 which are mounted on a frame 304 which is in turn mounted on the chassis frame 50 by a front hydraulic lift cylinder 306 and a pair of rear arms 308, 310. Frame 304 includes a rear cross brace 312 pivotally connected to the arms 308 and 310 and a front rod 314 pivotally connected at its front end to the lift cylinder 306 and at its rear end to a central portion of cross brace 312. Each of the tie locator assemblies 300, 302 is of identical construction and comprises a horizontal support bar 316 connected to and extending forwardly from the rear cross brace 312 of frame 304, a rear cam plate 318 extending downwardly from the support bar 316, and a front clamping plate 320 mounted on the support bar 316 and pivotable by a hydraulic clamp cylinder 322 from an out of the way position to a tie clamping position.

In use, tie alignment assembly 48 is normally lifted by retraction of lift cylinder 306 to a raised position in which the lift cylinder 306 and arms 308, 310 and the support bar 316 of each of the tie locator assemblies 300, 302 are generally parallel with one another and abut the bottom surface of chassis frame 50. Cam plate 320 is also retracted by retraction of clamp cylinder 322. A clearance of about 3" is provided between the bottoms of the rear clamping plates 318 and the rails 24 when the assembly 48 is in this position, thus precluding the machine 20 from catching on the rails. When tie positioning is desired, the machine 20 is positioned over a tie 98, and the lift cylinder 306 is extended to lower the locator assemblies 300, 302 to a position in which the rear clamping plates 318 abut or are disposed adjacent to the rear face of the tie 98. Clamp cylinders 322 are then actuated to pivot the cam plates 320 into contact with the front face of the tie 98 with sufficient force to shift the tie 98 into a position in which the tie 98 is securely clamped between the cam plates 320 and clamping plates 318 of the tie locator assemblies 300, 302 in alignment with the clip setting assemblies. The vertical guide rollers 52, 54, guide wheels 56, 58, and clamp assemblies 60, 62 permit the workheads 36, 38 to be supported on the rails 24, 26 during normal use. Thus, (referring to FIGS. 2 and 8) the clamp assemblies 60, 62 of each workhead each include clamping arms 108 pivotally mounted on opposed sides of the workhead frame. The clamping arms 108 of each clamp assembly has an upper end attached to a clamping cylinder 110 and a lower end receiving a clamping roller 112. Each clamping cylinder 110 has a cylinder portion pivotally connected to the workhead frame and a piston portion pivotally connected to the upper end of the clamping arm 108. The clamping roller 112 of each clamp assembly 60, 62 is rotatably mounted on the second end of the clamping arm 108 so as to roll along the rail 24, 26 during transport while at the same time assuring that the workhead 36, 38 is clamped in place directly above the rail 24, 26.

In use, the clip setting machine 20 is usually transported to the worksite with the workheads 36, 38 in their raised positions and with independent lowering of the clip setter assemblies 68, 70 being prevented by safety chains 114, 116 connecting the clip setter assemblies 68, 70 to the workheads 36, 38. The workheads 36, 38 are then lowered onto the rails 24, 26 by operation of the lift cylinders 40, 42, and the clamping cylinders 110 are then actuated to clamp the workheads 36, 38 to the rails 24, 26. The safety chains 114, 116 are then detached from the clip setter assemblies 68 and 70, and the clip setting machine 20 is driven from tie to tie to permit the clips 86 to be set in the tie sockets 96 as detailed below.

Each of the clip setter assemblies 68, 70 is adapted to receive clips 86 dispensed from a stack of clips by an associated clip dispensing assembly 64, 66, and to insert the thus received clips 86 in tie sockets 96. Each of the clip setter assemblies 68, 70 is of identical construction with the orientation of the gauge and field side clip setter assemblies 68, 70 of each of the workheads 36, 38 and of the corresponding clip dispensing assemblies 64, 66 being reversed for proper clip insertion. Thus, the following description of the field side clip setter assembly 68 of workhead 36 and of the corresponding clip dispensing assembly 64 is equally applicable to the corresponding gauge side clip setter assembly 70 and associated clip dispensing assembly 66 of the workhead 36 and for both clip dispensing and clip setting assemblies of the other workhead 38.

B. Construction of Clip Dispensing Assembly and Clip Setter Assembly

Referring now to FIGS. 1–10, the clip dispensing assembly 64 may be any assembly adapted to store clips and to selectively supply them one at a time to the corresponding clip setter assembly 68. The clip setter assembly 68 may be any assembly adapted to receive individual clips from clip dispensing assembly 64 and to set the individual clips in tie sockets 96. Pneumatic and hydraulic circuits 250 and 300 are provided for actuating various components of the clip dispensing assembly 64 and clip setter assembly 68.

In the illustrated embodiment, each clip dispensing assembly 64 comprises a magazine 118 adapted to store a stack of clips 86, and a roller conveyor 120 adapted to transfer individual clips from the magazine 118 to the clip setter assembly 68, 70. The magazine 118 and roller conveyor 120 are mounted on a common support frame 128 which is in turn bolted to slots (not shown) in a support block 130 so as to be laterally movable with respect to the support block 130 to permit lateral adjustment of the position of the clip dispensing assembly 64.

Referring now especially to FIGS. 5, 8, 9 and 10, the magazine 118 preferably takes the form of a generally e-shaped metal tube having an upper inlet 132 and a lower outlet 134 selectively closed by a trap door assembly 136. The tube permits as many as fifteen (15) clips to be stacked in the magazine 118 with their toes 88 and heels 91 facing the clip setter assembly 68, 70 and with their front arches 90 and center legs 94 facing tie socket 96. The trap door assembly 136 comprises a plate 138 which is pivotally attached to the lower end of magazine 118 and which, upon retraction of a pneumatically actuated dispensing cylinder 140, discharges a clip 86 onto the roller conveyor 120. Also provided on the magazine 118 are opposed clip stack support assemblies 142, 144 each of which includes a clip latch 146 pivotally mounted onto the magazine 118. Each clip latch 146 has a head extending into the magazine 118 and a tail extending away from the magazine and attached to a respective pneumatically operated clip stack support cylinder 148. Each of the clip latches 146 is movable, upon retraction of the associated clip stack support cylinder 148, from the position illustrated in phantom lines in FIG. 8 allowing unimpeded movement of the clips 86 through the magazine 118 to the position illustrated in solid lines in FIG. 8 in which it lifts the remaining clips 86 of the stack from the bottom clip to permit dispensing of the bottom clip 86 from the magazine 118.

Figure 6:
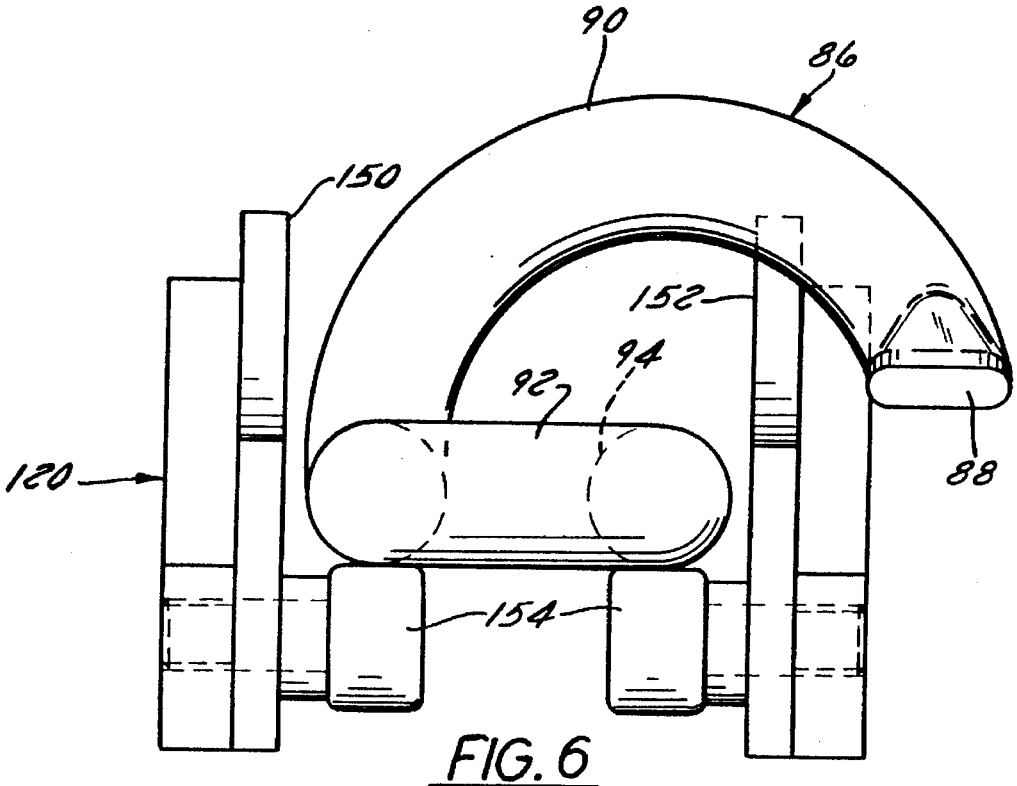
FIG. 6 is a perspective view illustrating the feed of a clip along a roller conveyor of the clip setting machine of FIGS. 1–4.
Figure 8:
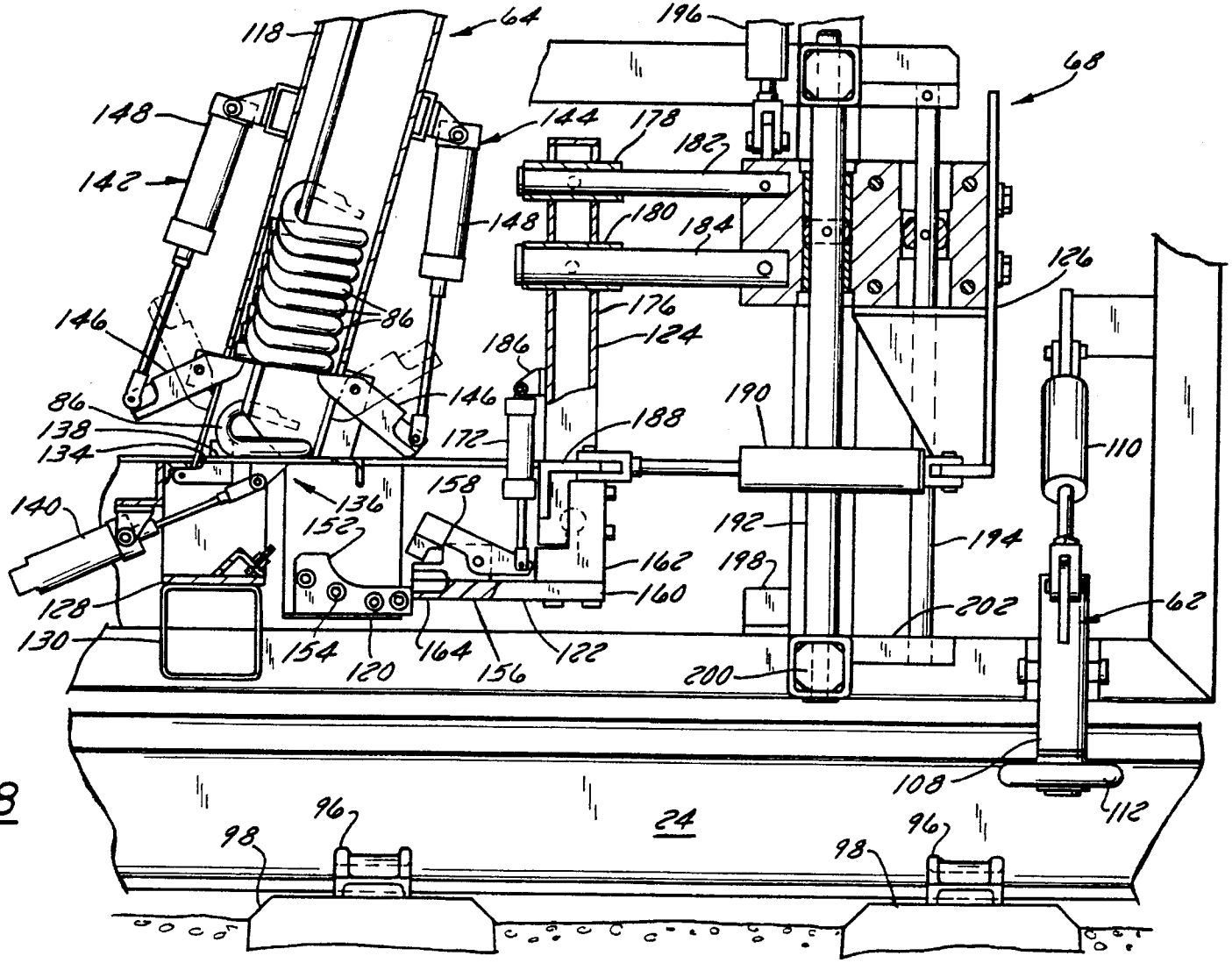
FIG. 8 is a partially sectional side elevation view of a clip setter assembly and clip dispensing assembly of the clip setting machine of FIGS. 1–4 and illustrating the assemblies prior to a dispensing operation.

Referring now to FIGS. 6 and 8, the roller conveyor 120 is preferably formed from opposed support plates 150, 152 and a plurality of rollers 154 mounted on the support plates 150, 152 so as to form a sloped rolling support surface for conveying the clips 86. Portions of the support plates 150, 152 extend above the rollers 154 so as to act as guide surfaces for the clips 86 as the clips travel along the conveyor 120.

The clip setter assembly 68 preferably comprises a clip setting tool 122 for receiving individual clips from the roller conveyor 120 and for setting the clips 86 in tie sockets 96, a support frame 124 on which the clip setting tool 122 is mounted for horizontal movement with respect to the workhead 36, and a guide block 126 on which the support frame 124 and clip setting tool 122 are mounted for vertical movement with respect to the workhead 36. The clip setting tool 122 preferably comprises a clip holder 156 and a clip retainer 158 cooperating so as to receive individual clips from the roller conveyor 120 and to transport the individual clips to the tie sockets 96 and to insert clips in the tie sockets 102.

Figure 7:
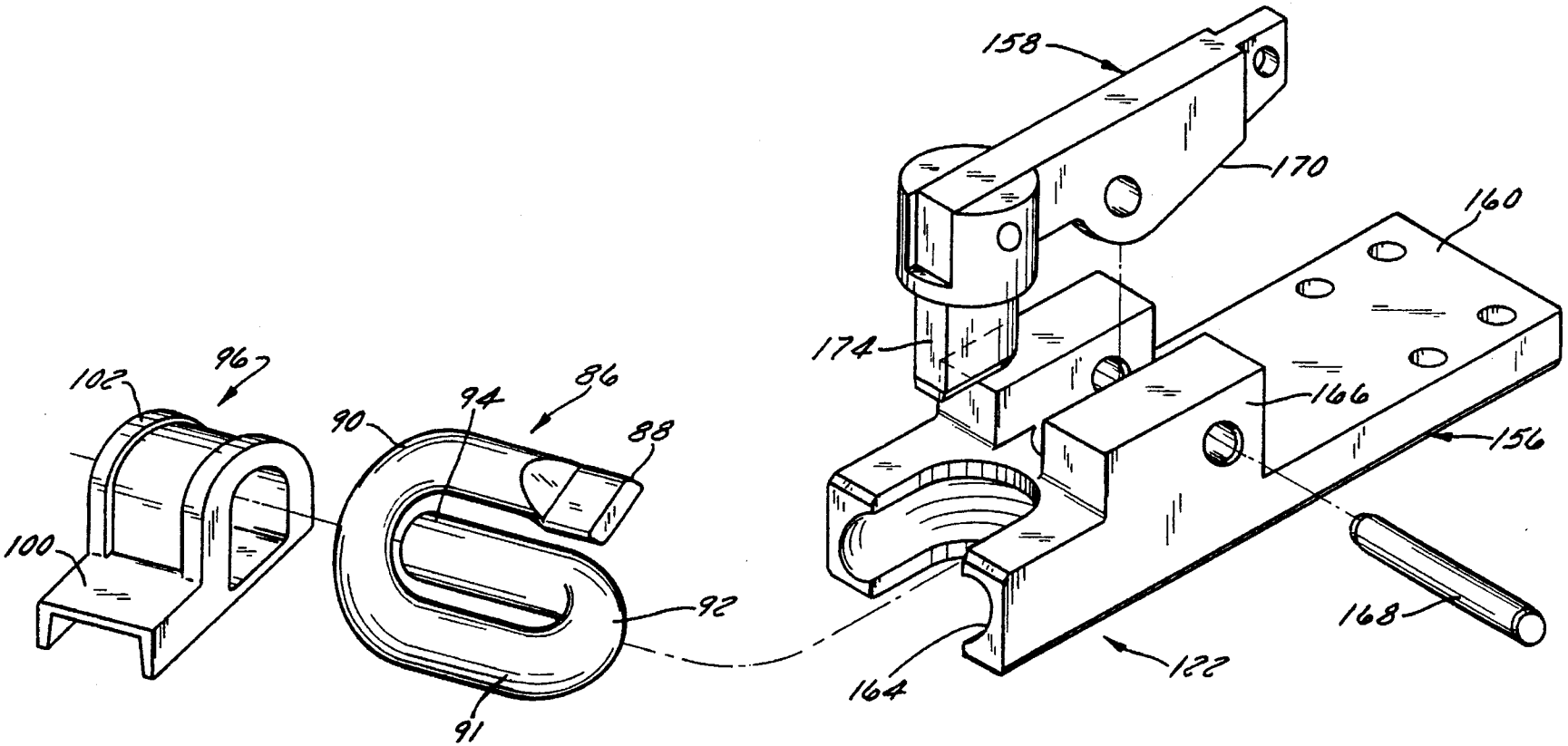
FIG. 7 is an exploded perspective view illustrating the relationship between a clip setting tool, a clip, and a clip anchor socket.
Figure 9:
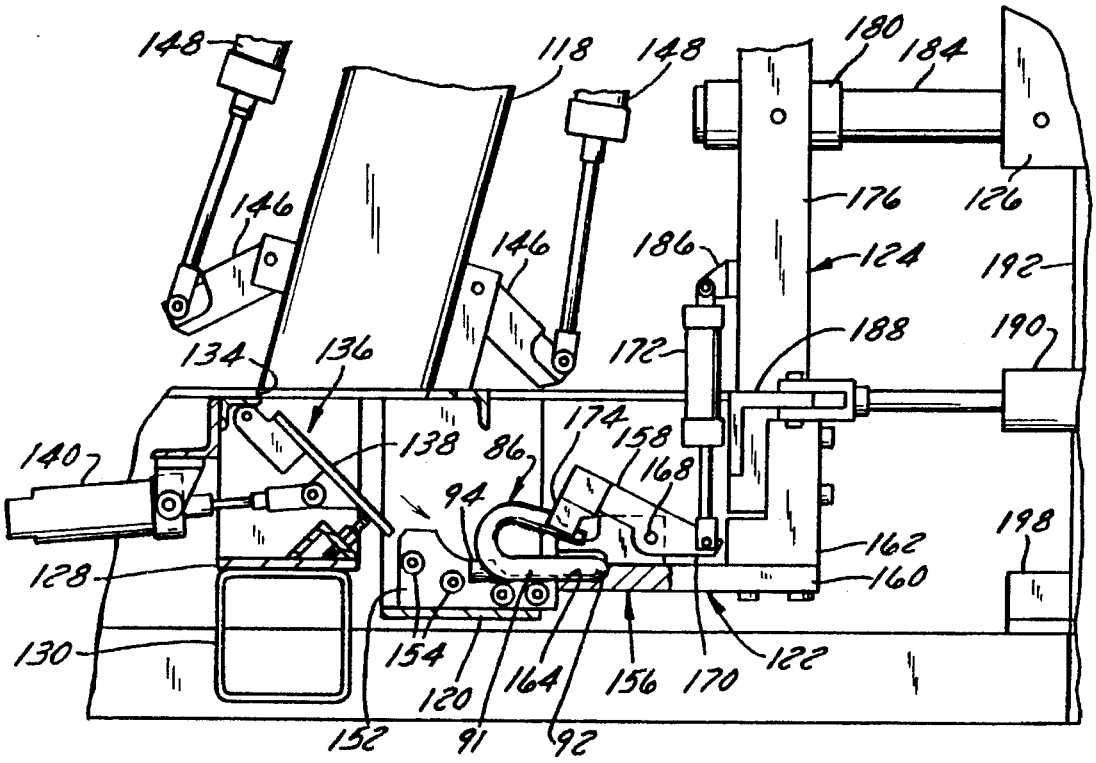
FIGS. 9–12 generally correspond to FIG. 8 and illustrate the operation of the clip setter and dispensing assemblies.
Figure 10:
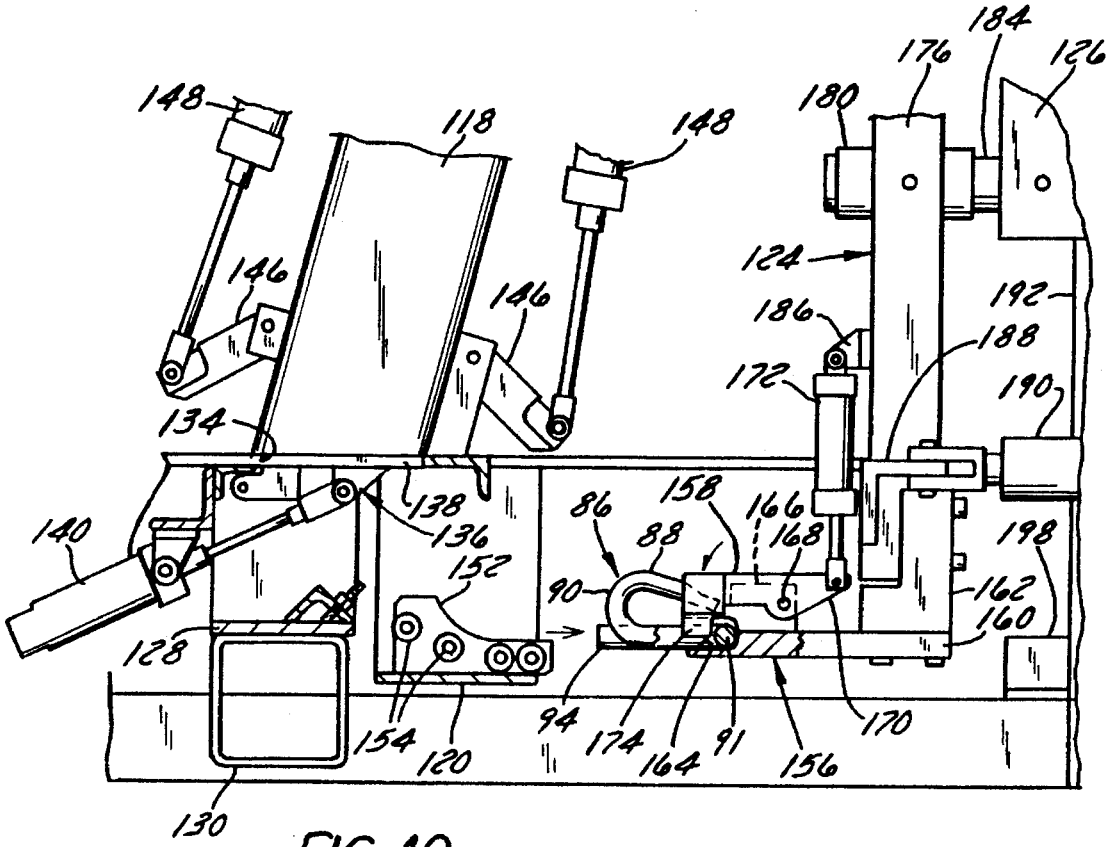
Figure 11:
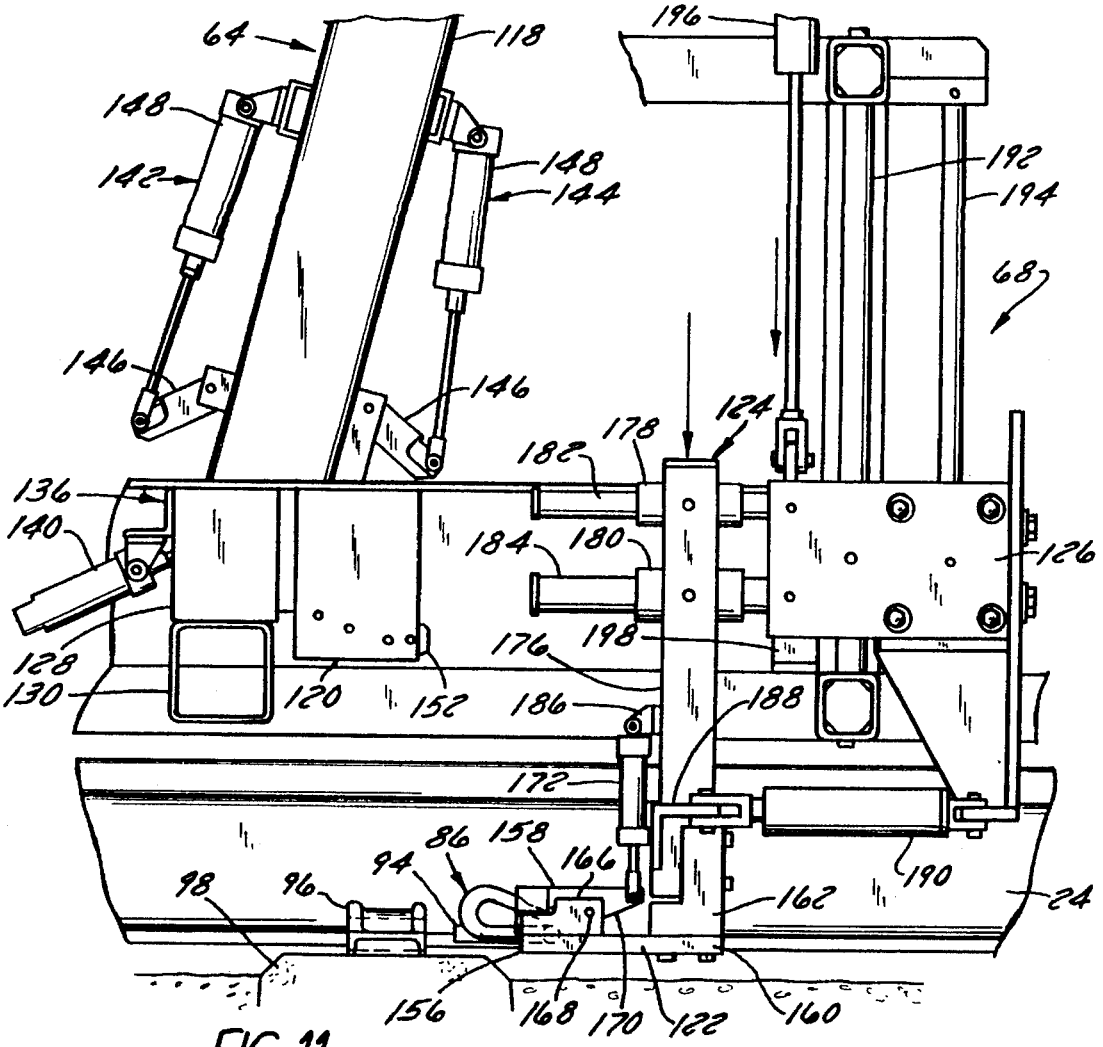
Figure 12:
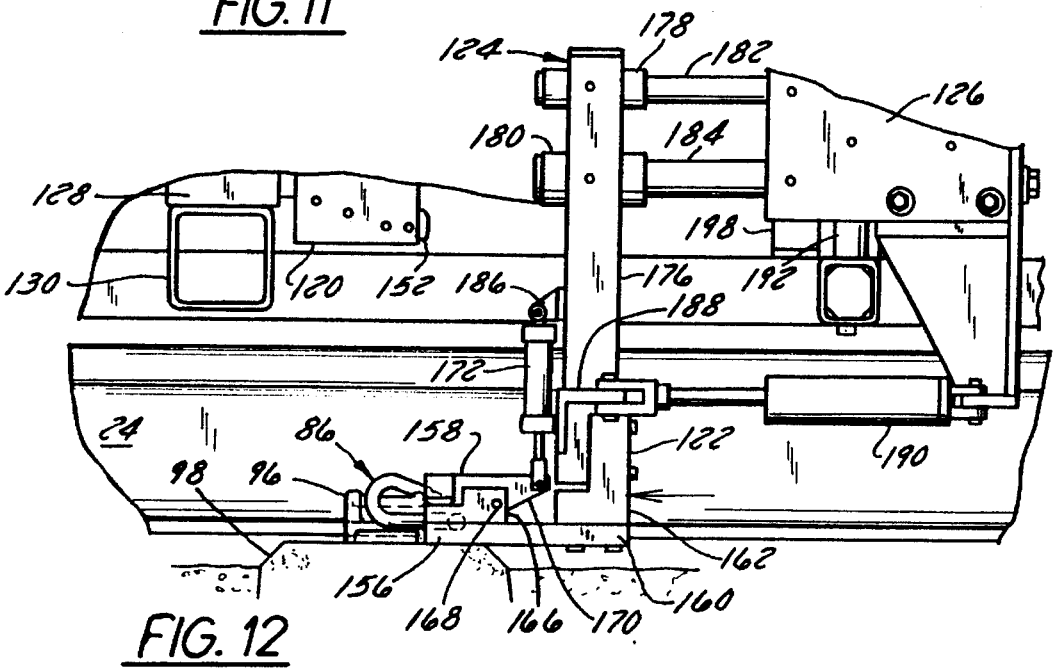

Referring now to FIGS. 7–12, the clip holder 156 includes a generally horizontal plate 160 supporting the clip retainer and a generally vertical plate 162 having a lower end bolted to the horizontal plate 160 and an upper end bolted to the support frame 124. The horizontal plate 160 has a front socket 164 (FIG. 7) which has a shape complimenting that of the rear arch 92 of the clip 86 and which is adapted to receive individual clips 86 as illustrated in FIGS. 7 and 9–10. A clevis 166 extends upwardly from the horizontal plate 160 behind the front socket 164 and is pivotally connected to the clip retainer 158 via a pivot pin 168.

The clip retainer 158 includes a support arm 170 (FIG. 7) which (1) is mounted on the horizontal plate 160 of the clip holder 156 by the pivot pin 168 at a central portion thereof, (2) is connected to a retaining cylinder 172 at a rear end thereof, and (3) receives a clip latch member 174 at a front end thereof. The clip latch member 174 is operable, upon retraction of the retaining cylinder 172 and corresponding pivotal movement of the support arm 170, to engage the rear arch 92 of the clip 86, thereby holding the clip 86 in position.

The support frame 124 is designed to support the clip holder 156 for vertical and horizontal movement with respect to the workhead 36 and includes a generally vertical tube 176 supporting upper guide sleeves 178, 180 for receiving stabilizer rods 182, 184. Also mounted on the support frame 124 are a bracket 186 for supporting the retaining cylinder 172, and a bracket 188 for supporting the first end of a clip setting cylinder 190. The remote ends of both the clip setting cylinder 190 and the stabilizer rods 182, 184 are connected to the guide block 126 so as to permit horizontal movement of the clip setting tool 122 and support frame 124 along the stabilizer rods 182, 184 upon actuation of the clip setting cylinder 190.

The guide block 126 is designed to support the support frame 124 and thus the clip setting tool 122 for vertical movement with respect to the workhead 36 and to permit adjustment of the clip setting tool 122 with respect to the workhead. To this end, the guide block 126 receives the stabilizer rods 182, 184 as discussed above and is mounted on front and rear vertical guide rods 192, 194 so as to move vertically along the guide rods 192, 194 upon actuation of a hydraulic lift cylinder 196 connected to the guide block 126 and to the frame of the workhead 36. Lowering of the guide block 126 with respect to the workhead 36 is limited by a support block 198 the height of which is preferably adjustable, e.g., by turning the block 198 on its side. Adjusting the extent of travel of the guide block 126 in this manner permits vertical adjustment of the clip setting tool 122 and thus permits alignment of the setting tool 156 with tie sockets of different configurations. The front and rear guide rods 192, 194 are bolted to a lateral adjustment bar 200 and to a retaining plate 202, respectively, to permit positioning of the guide block 126 and thus of the clip setting tool 122 with respect to the tie sockets 96. That is, the front guide rod 192 is bolted to a slot in lateral adjustment bar 200, and the retaining plate 202 receiving the rear guide rod 194 is bolted to a slot in the frame of the workhead 36. The front and rear guide rods 192, 194 can thus be moved together to permit lateral positioning of the entire clip setter assembly 68 just as the position of the clip dispensing assembly 64 can be adjusted as discussed above. Alternatively, the retaining plate 202 can be moved independently of the lateral adjustment bar 200 so as to cause the guide block 126, support frame 124, and clip setting tool 122 to pivot about the front guide rod 192, thus changing the angle of the clip setting tool 122 with respect to the rail 24. This may be necessary in some instances in which the rail 24 is canted with respect to the ties 98.

C. Operation of Clip Dispensing Assembly and Clip Setter Assembly

In operation, after the clip setting machine 20 is transported to the work site and mounted on the rails 24, 26, the workheads 36, 38 are lowered onto the rails 24, 26, clamped to the rail, and positioned over a tie 98 as discussed above. The cylinders 306 and 322 of the tie alignment assembly 48 is then actuated to align the tie 98 with respect to the workheads 36, 38 as described above. These operations, as well as initiation of the clip setting sequence, are preferably performed by a first operator seated in seat 46. Meanwhile, a second operator, positioned in seat 44, simultaneously loads two magazines 118 with clips 86. A clip setting sequence then takes place as follows:

First, the clip stack support cylinders 148 are retracted from their inactive position illustrated in phantom lines in FIG. 8 to their active positions lifting the remaining clips of the stack from the bottom clip 86. The dispensing cylinder 140 is then actuated to open the trap door assembly 136 to dispense the bottom clip 86 onto the roller conveyor 120. The clip 86 then rolls along the roller conveyor 120 and into the socket 164 of the clip holder 156, thus completing the dispensing operation as illustrated in FIG. 9.

The clip setting operation is then initiated by retracting the retaining cylinder 172 to pivot the clip retainer 158 into its clip retaining position. The clip setting cylinder 190 is then retracted to move the support frame 124 and clip setting tool 122 horizontally away from the roller conveyor 120 to permit unhindered lowering of the clip setting tool 122 as illustrated in FIG. 10. The lift cylinder 196 is then actuated to lower the guide block 126, support frame 124, and clip setting tool 122 to the position illustrated in FIG. 11 in which the clip 86 is horizontally aligned with the tie socket 96. Then, the clip setting cylinder 190 is again extended to move the clip setting tool 122 in the direction of the arrow in FIG. 12 to insert the clip 86 into the tie socket 96. It should be emphasized that this insertion does not actually "apply" the clip in that it does not apply significant tensioning forces to the clip. It merely sets the clip 86 in the socket 102 to permit application of the clip either manually or by an automatic device such as the one disclosed in the McIlrath patent cited above.

After the clip 86 is set, the retaining cylinder 172, clip setting cylinder 190, and lift cylinder 196 are retracted in sequence, and the clip setting cylinder 190 is again extended to prepare the clip setter assembly 68 for receiving the next clip. Dispensing cylinder 140 is also extended and the clip stack holding cylinders 148 retracted during this operation to ready the clip dispensing assembly 64 for the next dispensing cycle.

The clip setting sequence described above could take place manually via operation of levers or switches controlling operation of the respective cylinders. However, the sequence is preferably performed automatically upon actuation of a suitable switch or lever, with suitable switches or sensors controlling the sequence of the remaining operations. An especially preferred sequencing structure and method will now be described.

D. Construction and Operation of Pneumatic and Hydraulic Control Circuits

Figure 3:
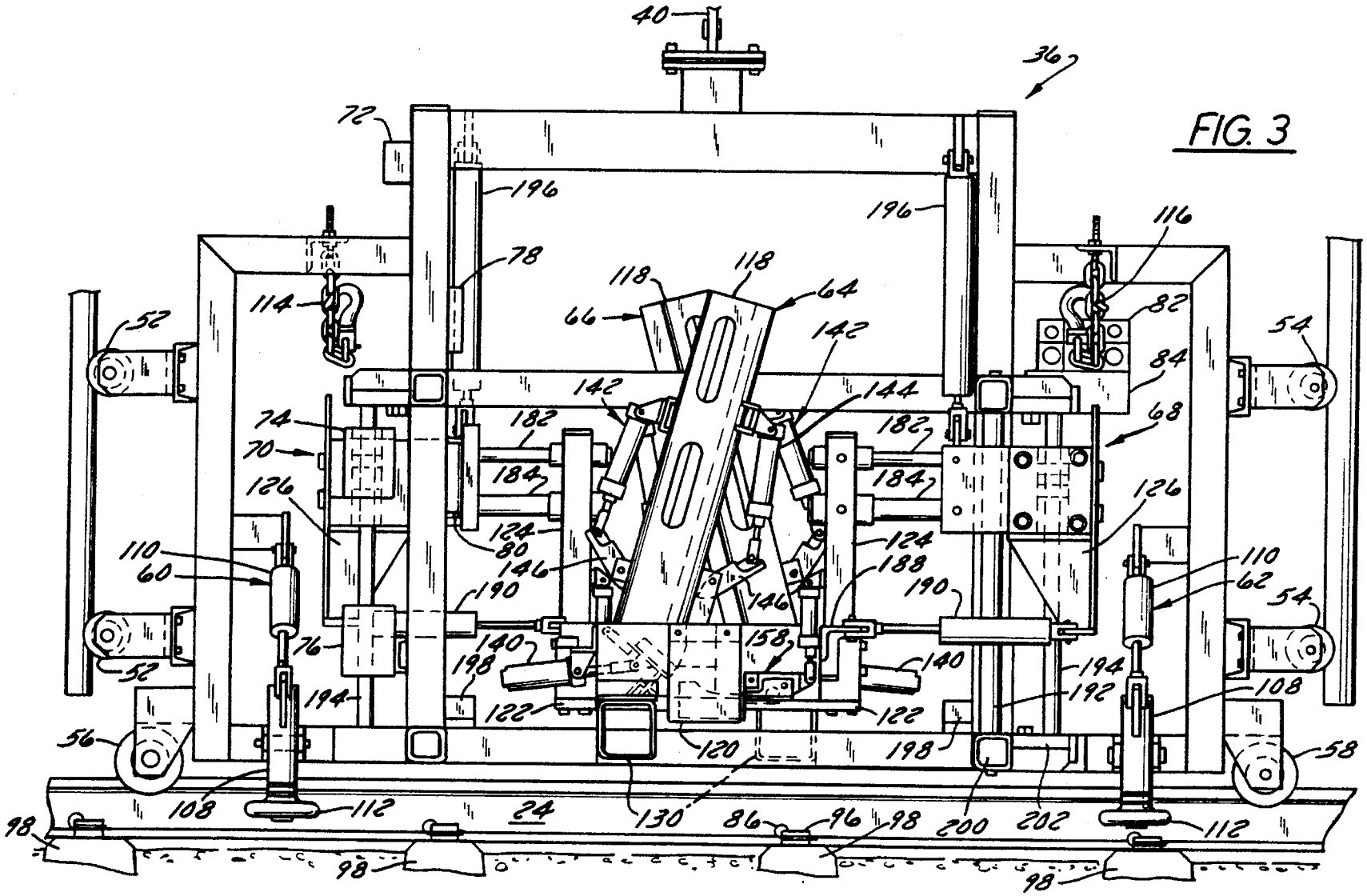
FIG. 3 is a side elevation view of a first workhead of the clip setting machine of FIGS. 1 and 2.
Figure 4:
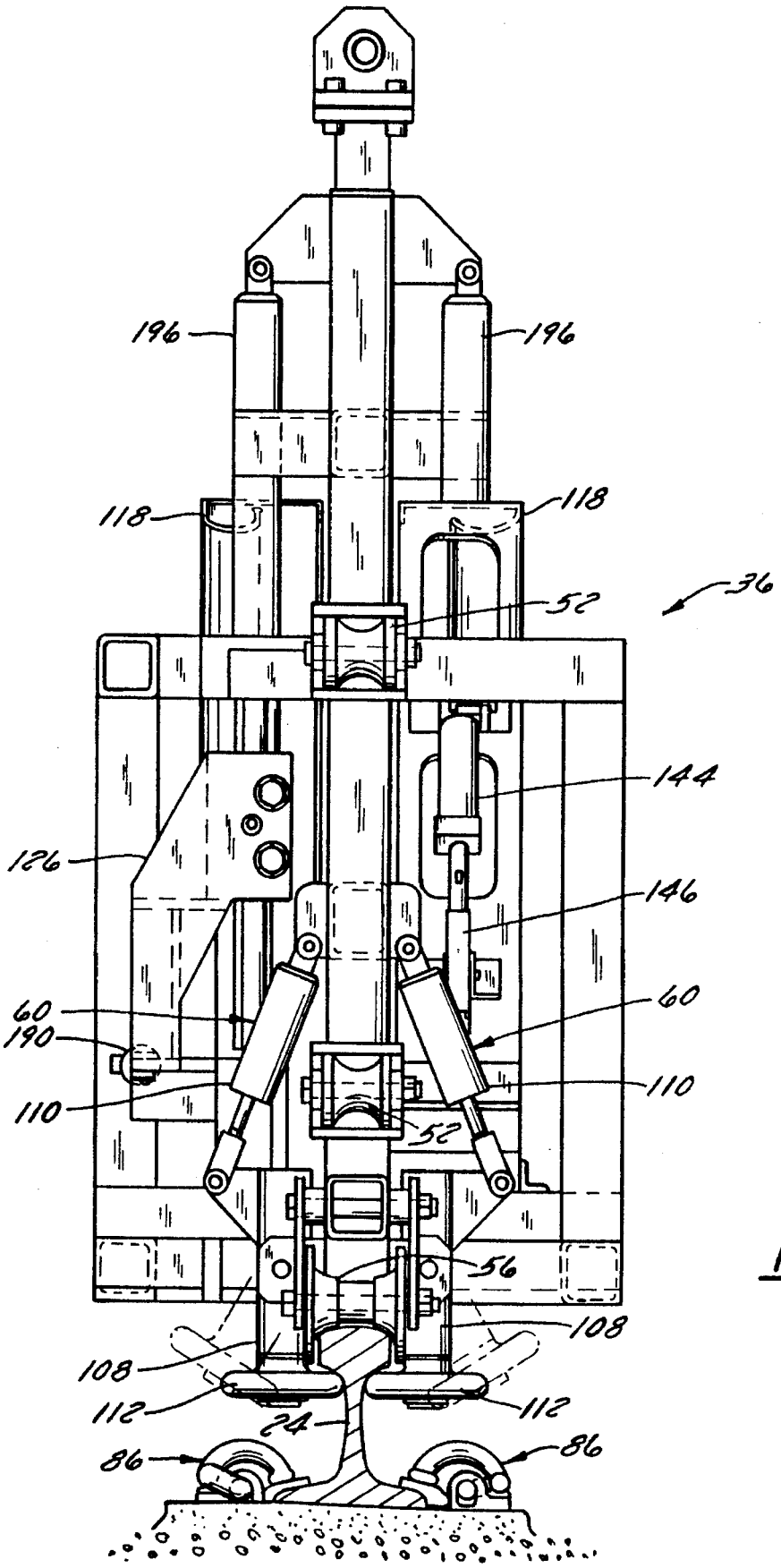
FIG. 4 is an end elevation view of the workhead of FIG. 3.
Figure 13:
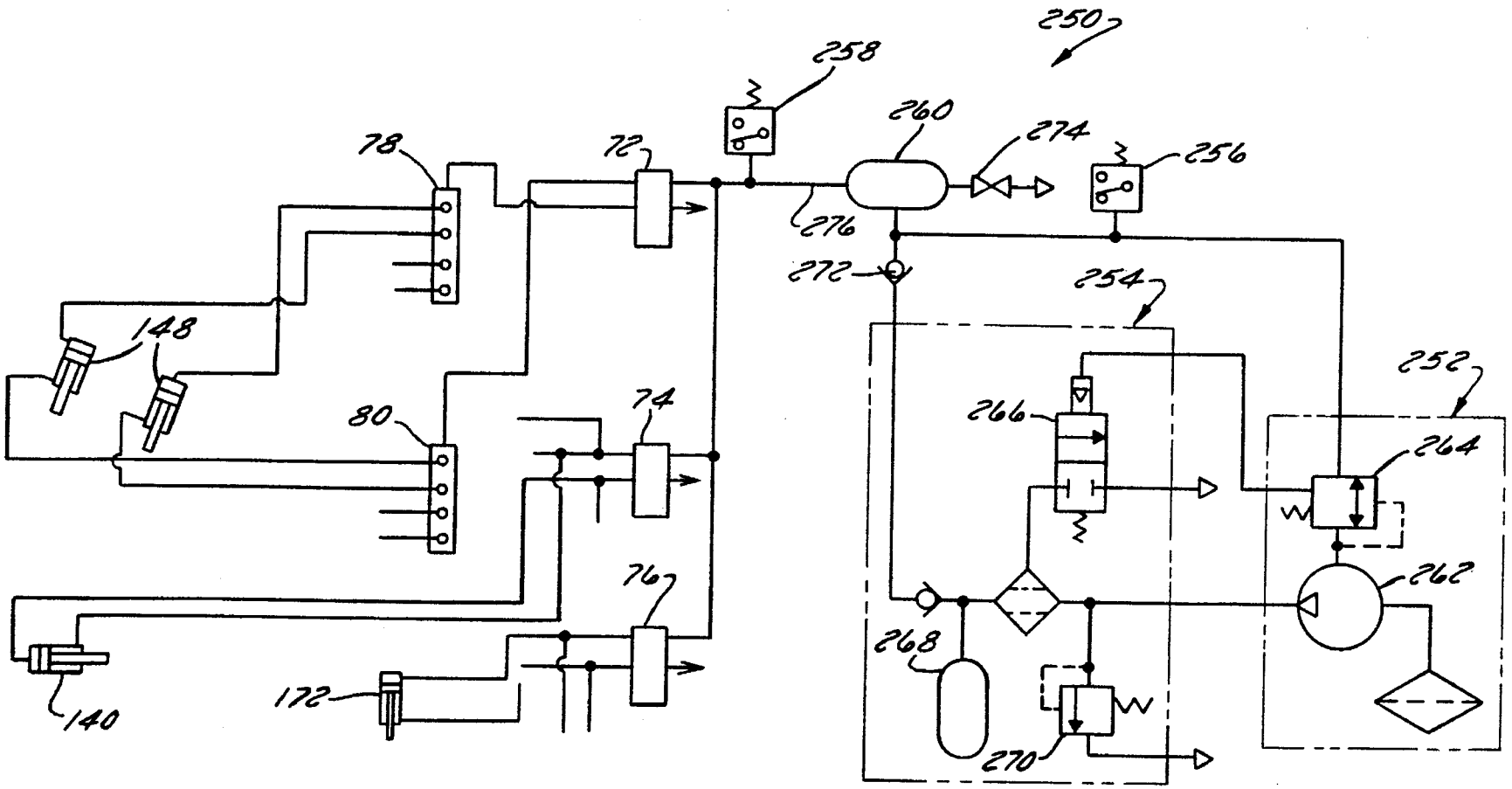
FIG. 13 is a pneumatic circuit diagram of the clip setting machine of FIGS. 1–12.
Figure 14:
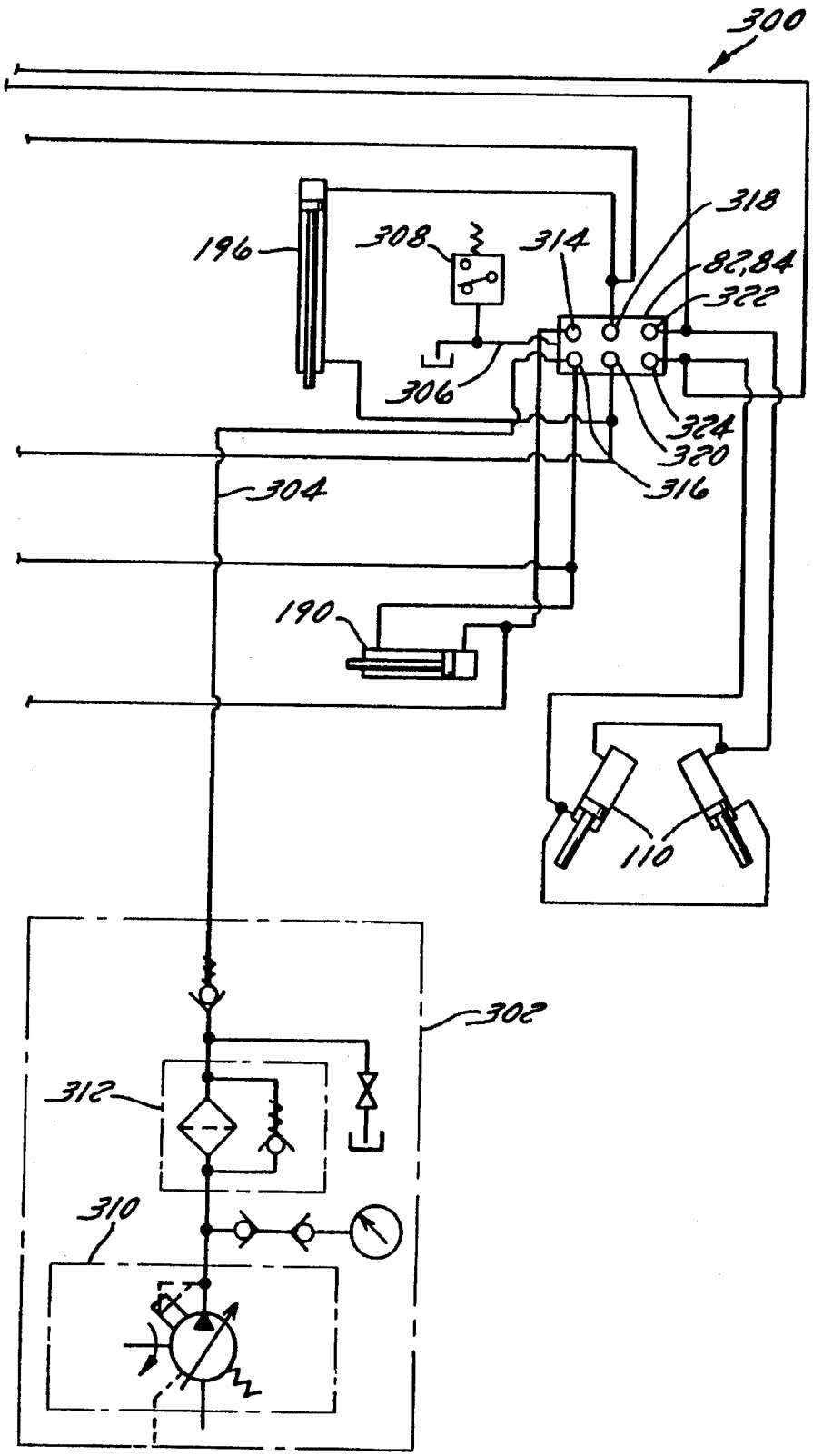
FIG. 14 is a hydraulic circuit diagram of the clip setting machine of FIGS. 1–12.
Figure 15:
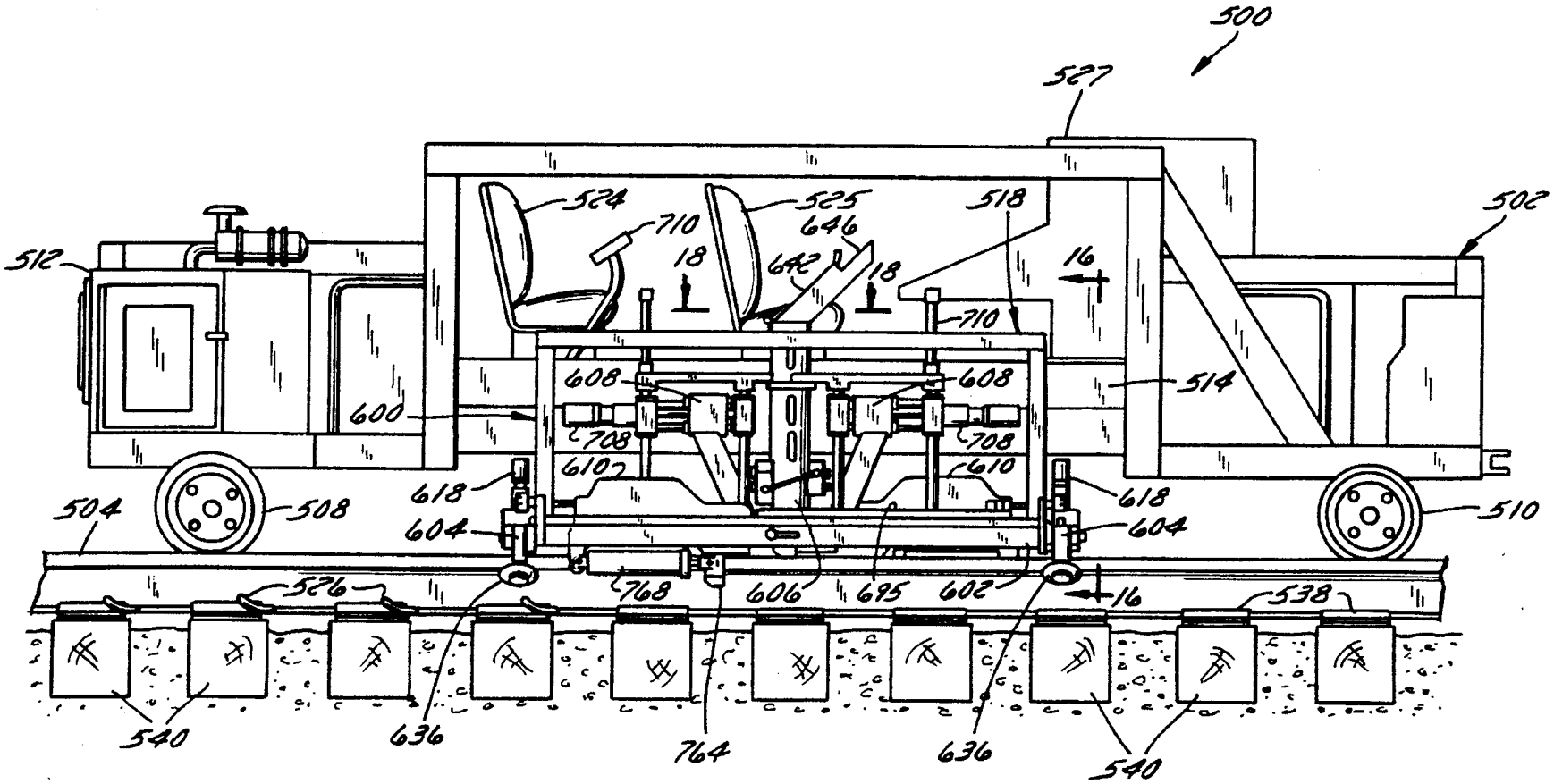
FIG. 15 is a side elevation view of a clip applicator machine constructed in accordance with a preferred embodiment of the invention.
Figure 16:
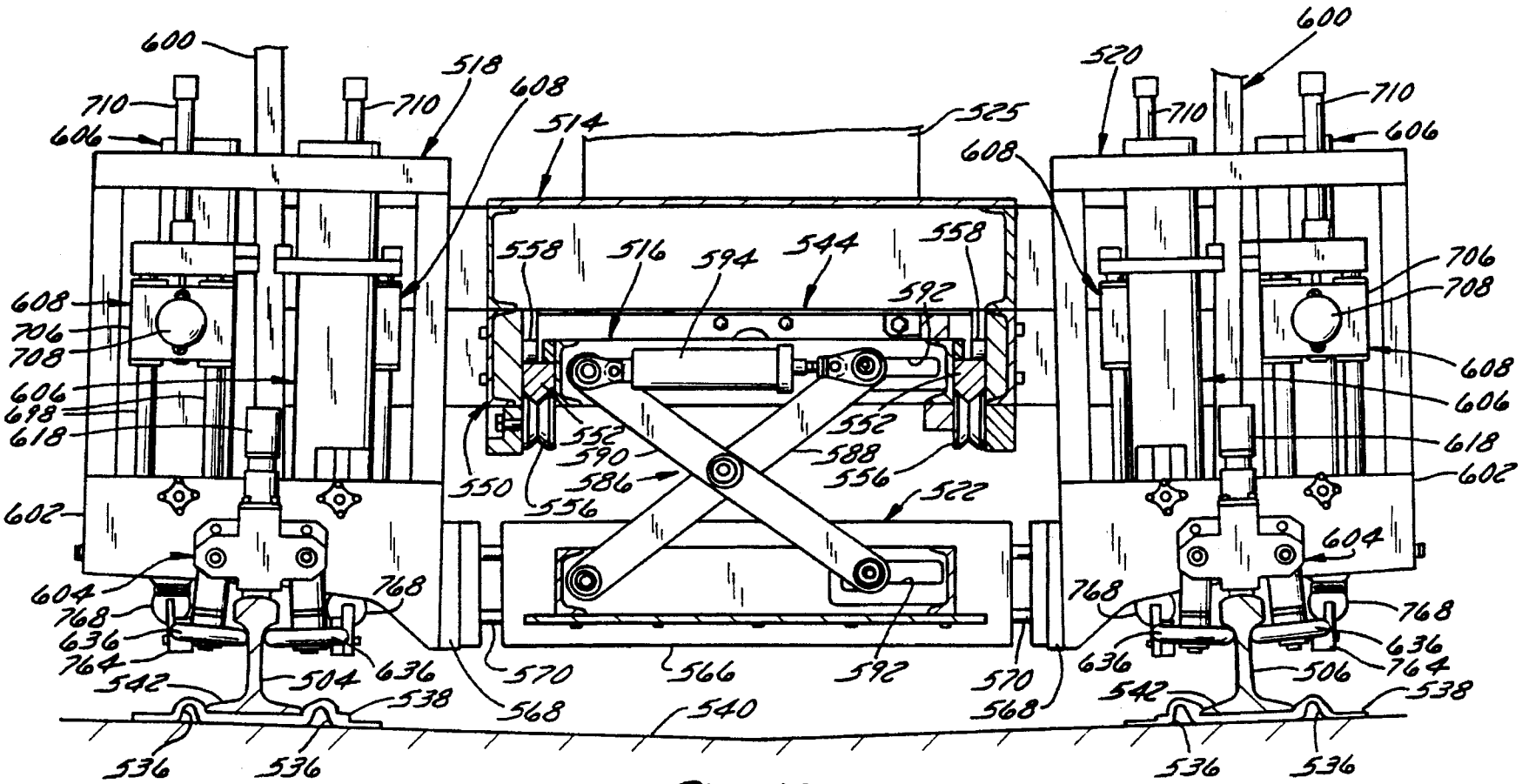
FIG. 16 is a sectional end elevation view of a portion of the clip applicator machine taken along the lines 16—16 in FIG. 15, illustrating the lift mechanism of the machine in a lowered or working position.
Figure 17:
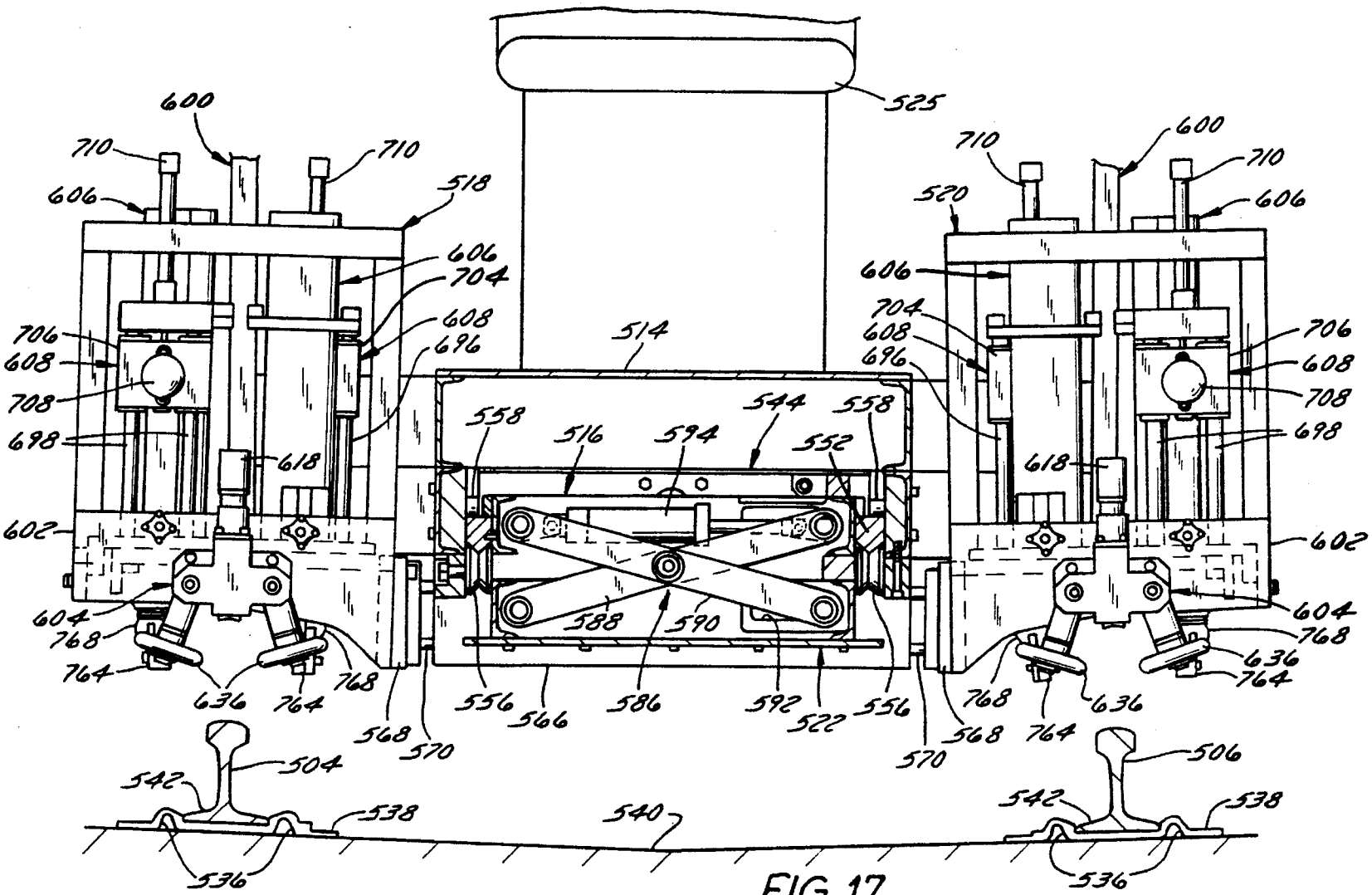
FIG. 17 is a sectional end elevation view of a portion of the clip applicator machine of FIG. 15, illustrating a lift mechanism of the machine in an elevated or transport position.
Figure 18:
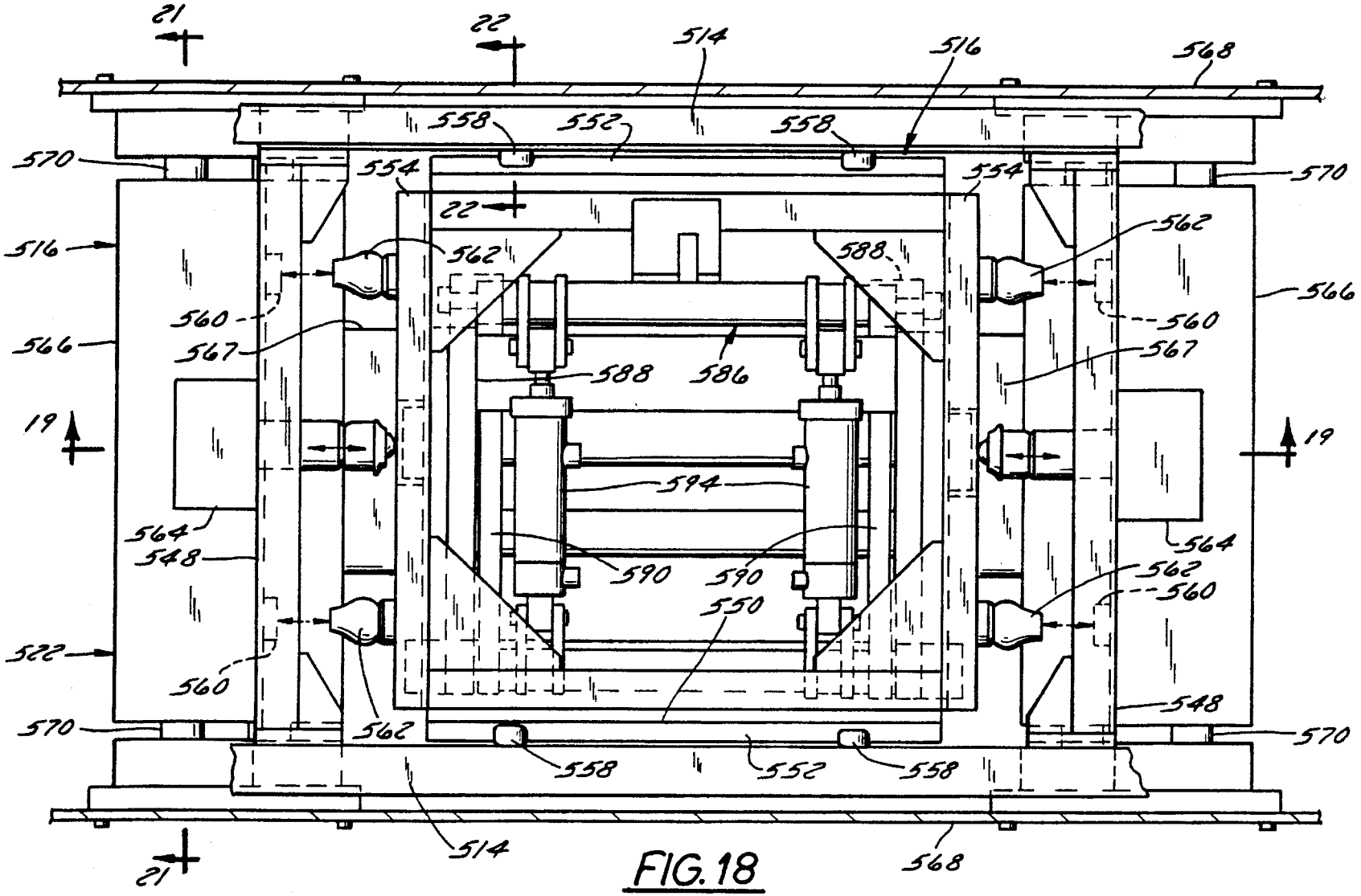
FIG. 18 is a sectional plan view of the lift mechanism taken along the lines 18—18 in FIG. 15.
Figure 19:
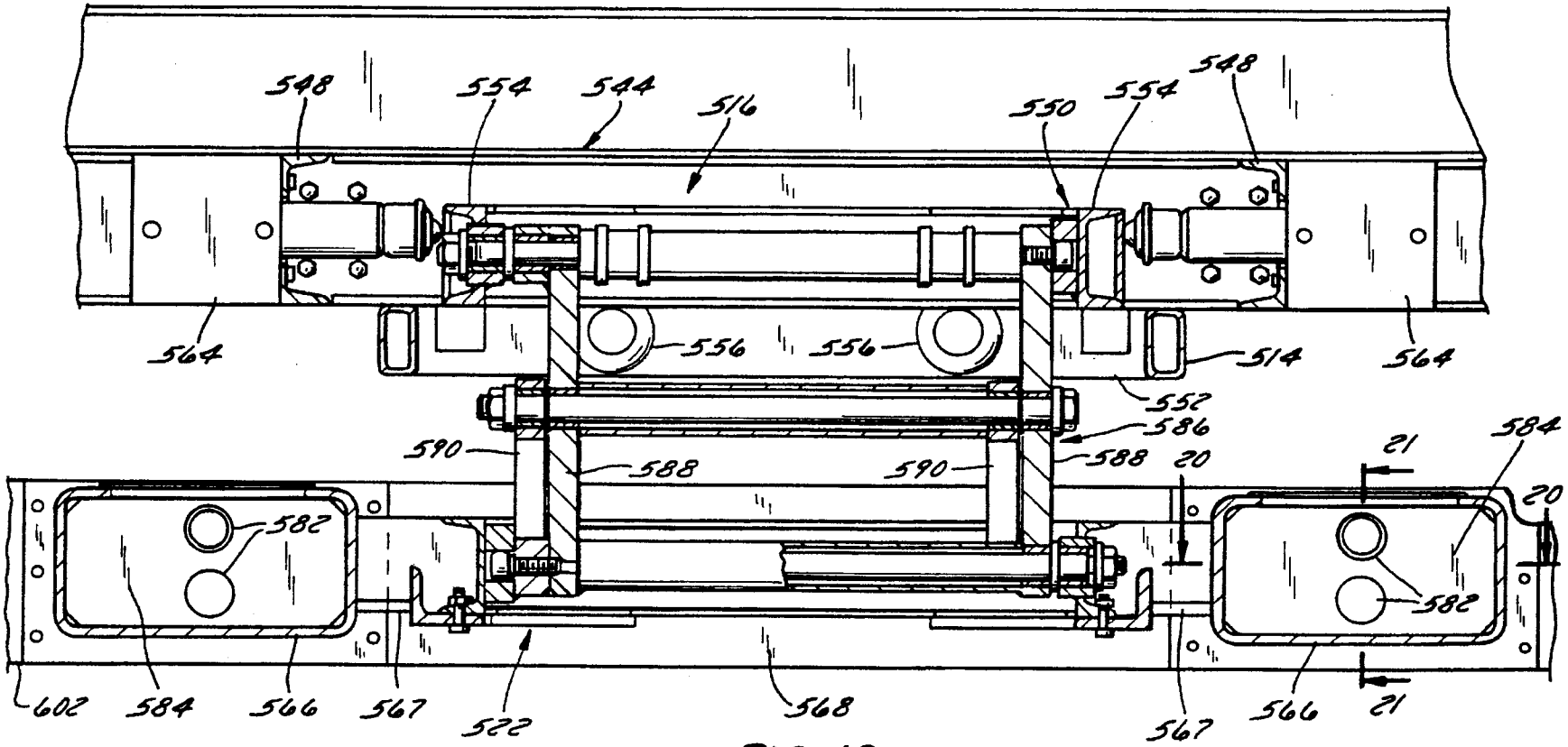
FIG. 19 is a side sectional elevation view of the lift mechanism taken along the lines 19—19 in FIG. 18.
Figure 20:
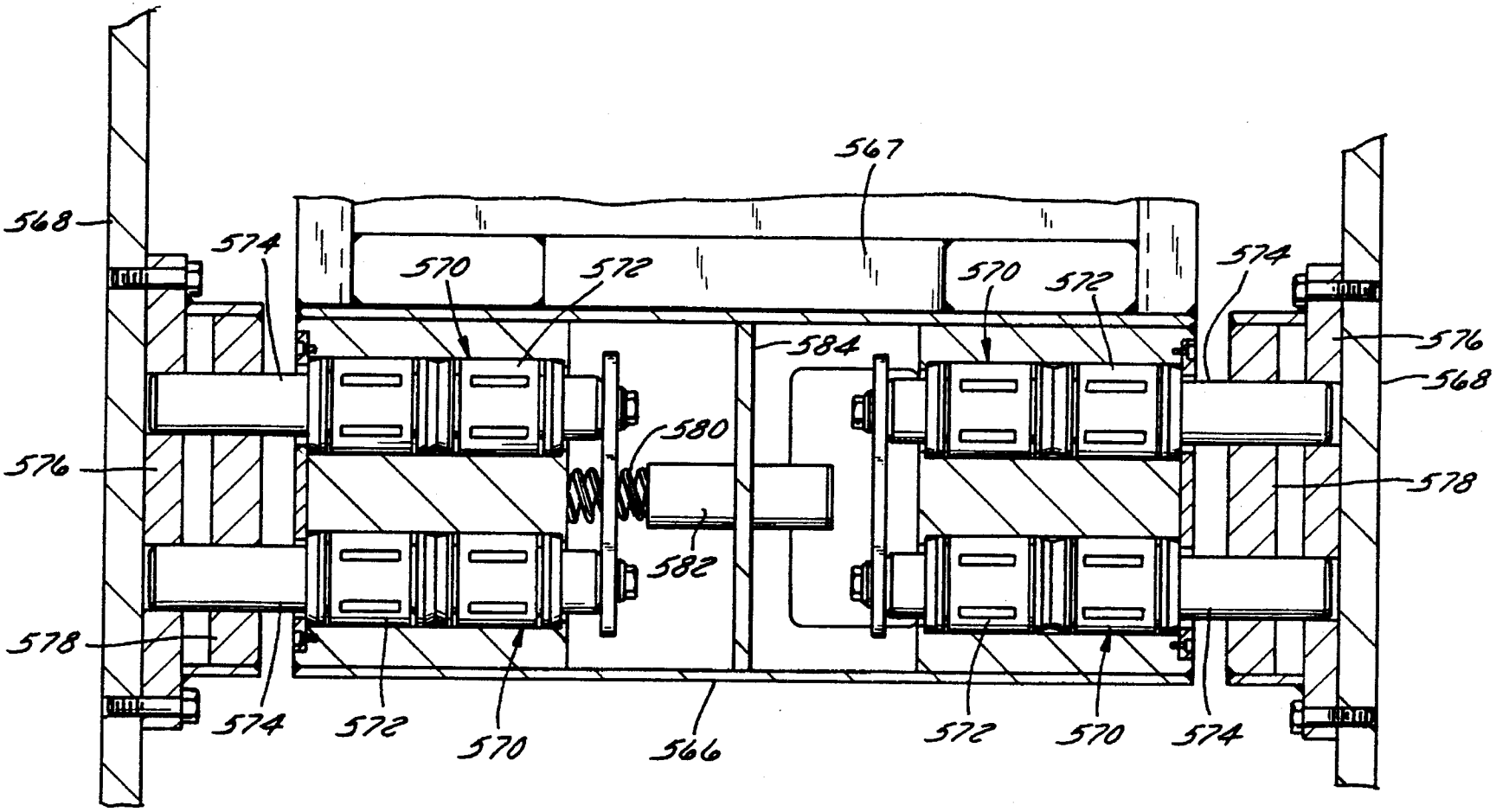
FIG. 20 is a sectional end view taken along the lines 20—20 in FIG. 19.
Figure 21:
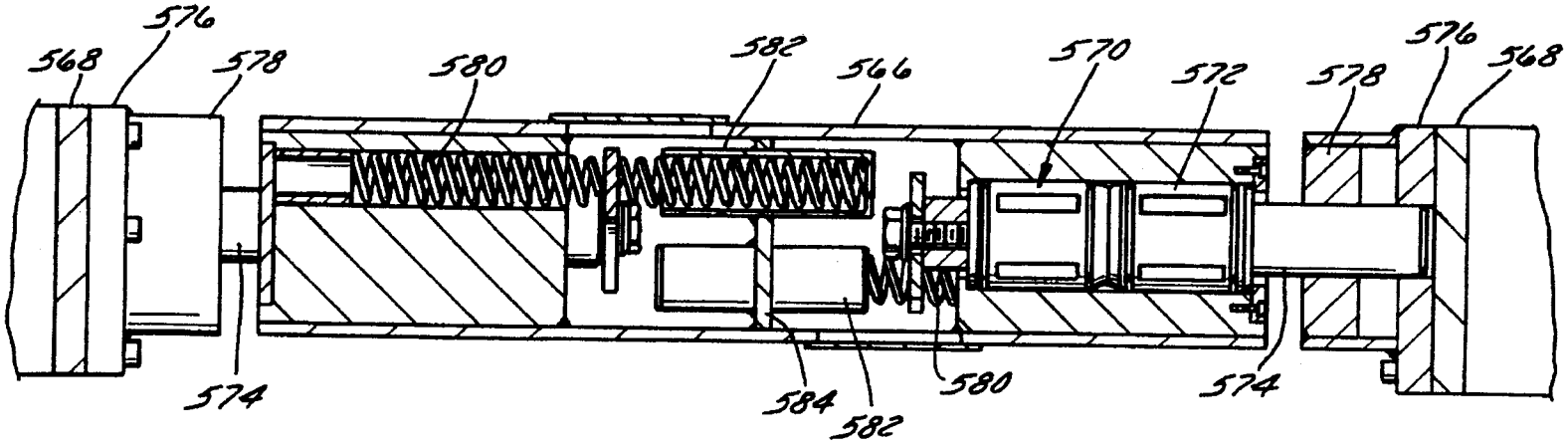
FIG. 21 is a sectional plan view taken along the lines 21—21 in FIG. 19.
Figure 22:
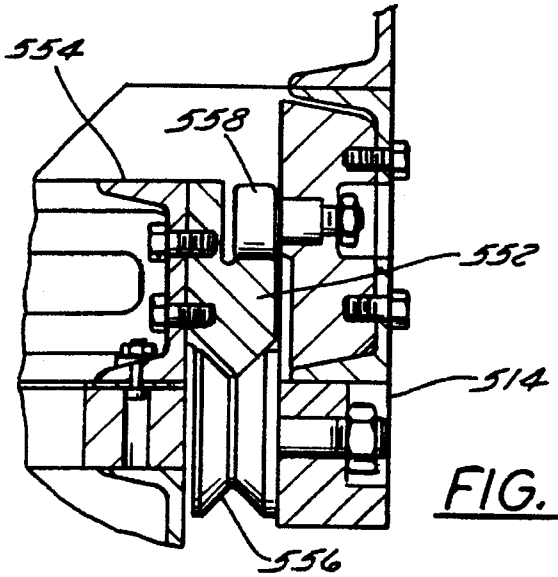
FIG. 22 is a sectional view taken along the lines 22—22 in FIG. 18.

Referring now to FIGS. 3, 13, and 14, the clip stack support cylinders 148, dispensing cylinders 140, and clip retaining cylinders 172 of each workhead 36, 38 are preferably controlled by respective first, second, and third pneumatic valves 72, 74, and 76 described briefly above. The clamping cylinders 110, clip setting cylinders 190, and lift cylinders 196 are likewise controlled by a valve block 82 supported on a common manifold 84, also described briefly above. All of these valves are controlled by a common controller or ECU (not shown). Each of the valves preferably comprises a four-way two-position solenoid valve selectively supplying pressurized fluid to the piston and cylinder ends of the respective cylinders while venting the other of the piston and cylinder ends. Preferred pneumatic and hydraulic circuits 250 and 300 including these valves will now be described.

Referring now to FIG. 13, pneumatic circuit 250 includes a pressure source 252, a pressure control device 254, the valves 72, 74, 76 and manifolds, 78, 80, and monitors 256 and 258. Each of the valves 72, 74 and 76 has an inlet port connected to a common supply line 276, control ports connected to the piston and cylinder ends of the respective cylinder, and an exhaust port connected to atmosphere. An accumulator 260 is disposed in supply line 276 between the pressure control device 254 and the valves 72, 74, and 76.

Pressure source 252 and pressure control device 254 may comprise any devices capable of supplying pressurized air at a desired pressure. In the illustrated embodiment, pressure source 252 includes a compressor 262 and a pressure limiter 264 controlled by the monitor 256 (preferably comprising a flow switch) in a manner which is, per se, well known. Pressure control device 254 includes a flow control valve 266, an accumulator 268, and a pressure limiter 270. A check valve 272 separates the pressure control device 254 from the accumulator 260, and a dump valve 274 is provided to permit selective depressurization of accumulator 260.

Each valve 72, 74, 76 is operable to selectively connect one of the control ports to the supply line 276 and to connect the other control port to atmosphere. Each of the valves 74, 76 is preferably coupled directly to the cylinders 140, 172 of both dispensing or clip setter assemblies of an associated workhead 36 or 38, and each valve 72 is similarly connected to all four clip stack cylinders 148 of each workhead indirectly via the manifold 78 and 80.

Referring now to FIG. 14, hydraulic circuit 300 includes, in addition to the valve block 82 and the manifold 84, a pressure source 302, a common supply line 304, and a common vent or exhaust line 306. A monitor 308 is provided in exhaust line 306 for reasons detailed below. Pressure source 302 is conventional and includes a pump assembly 310 and a suitable filtration system 312. Other portions of the circuit 300, not shown, are likewise conventional and control positioning of the chassis 12 and raising and lowering of the workheads 36 and 38 via lift cylinders 40, 42. A discussion of these other portions and of the pressure source 302 is omitted for the sake of brevity.

Valve block 82 preferably comprises 6 ports 314, 316, 318, 320, and 324, each of which is coupled to the piston/or cylinder ends of all of the corresponding cylinders 110, 190, and 196 mounted on a given workhead 36, 38. The individual connections are believed to be easily constructed by those skilled in the art and, accordingly, will not be described in further detail.

The circuits 250 and 300 of each workhead 36, 38 are preferably controlled such that the solenoid valves 72 for the clip stack lift cylinder 148 of the clip dispensing assemblies 64 and 66 of both workheads 36, 38 are energized by the manual actuation of a lever or switch, and such that the valves for the remaining cylinders of both workheads are sequentially and automatically energized upon full extension of the preceding cylinder. The term "full extension" as used herein with respect to the operation of a cylinder does not necessarily mean that the piston has been extended from the cylinder by its maximum possible amount. Rather, this term means that further movement of the piston in a direction resulting in actuation of the associated device is prevented either by maximum piston stroke into or out of the cylinder or by engagement of the device operated by the piston with some element inhibiting further piston or cylinder movement.

Many devices could be used to provide the desired sequential and automatic operation of the cylinders. For instance, an ECU could receive signals from limit switches, pressure switches, or the like and trigger sequential operation using a suitable control logic. A more simplified construction is preferred however, in which the controllers comprise fluid flow switches 258 and 308 which are closed when the fluid flow changes in the associated line 276 or 306 upon full cylinder or piston extension as defined above, thereby completing a circuit supplying power to the next solenoid valve.

The operation of the circuits 250 and 300 under the control of the flow switches 258 and 308 is believed to be self-evident from the above discussions and will not be described in detail. Suffice it to say that these switches, upon actuation of the main control switch and operation of the clip stack lift cylinders 148, cooperate with the ECU to actuate the cylinders of each of the workheads 36, 38 in the following sequence:

1. retraction of the dispensing cylinder 140;
2. retraction of the retaining cylinder 172;
3. retraction of the clip setting cylinder 190;
4. extension of the lift cylinder 196;
5. extension of the clip setting cylinder 190;
6. extension of the retaining cylinder 172;
7. retraction of the clip setting cylinder 190;
8. retraction of the lift cylinder 196; and
9. extension of the clip setting cylinder 190.

In addition, the dispensing cylinders 140 are extended and the clip stack lift cylinders 148 are retracted in any suitable manner between Step No. 4 and Step No. 9.

Ill. Clip Applicator Machine

As discussed above, and pursuant to the present invention, it also desirable in some instances to provide a machine which both sets and applies clips. A preferred embodiment of one such machine will now be detailed.

A. System Overview

Referring now to FIGS. 15–47, a clip applicator machine 500 constructed in accordance with the present invention includes a self-propelled chassis 502 which is movably supported on rails 504, 506 by front and rear wheels 508, 510 and which is driven by hydraulic motors (not shown) which are in turn driven by an engine 512. Chassis 502 presents a frame 514 on which a lift mechanism 516 is mounted for longitudinal movement with respect thereto. Two workheads 518 and 520 are mounted on a opposed transverse ends of a lower portion or float frame 522 of the lift mechanism 516 so as to be movable vertically with respect to the upper portion of the lift mechanism 516 and the chassis frame 514 upon demand. An operator's seat 524 is supported on the frame 514 between the workheads 518 and 520 to provide a work station for the machine's operator, and a loader's seat 525 is provided behind the operator's seat 524 to provide a workstation for an assistant who transfers clips 526 from a hopper 527 to the magazines.

The purpose of the clip applicator machine 500 is to install spring-type clips, preferably e-type spring clips 526 in sockets. As discussed above, and referring, e.g., to FIGS. 26 and 28, clips of this type each take the form of a generally cylindrical rod bent into a shape having a first free end portion 528 forming a toe, an outwardly curved front arch 530, a heel 532, a rearwardly curving rear arch 534, and a second free end portion forming a center leg 537 disposed generally between the toe 528 and the heel 532. The clips 526 are designed to be inserted into anchor sockets 536 to attach the rails 504, 506 to tie plates 538 using spring forces. The tie plates 538, which contain the sockets 536, are embedded in or attached to concrete or wooden ties 540 in a conventional manner. In the applied position of clip 526, substantial spring forces are applied by the toe 528 to the base 542 of the rail 504, through the insulator, when the center leg or stem 537 is driven into the anchor socket 536 during the application process.

Fluid circuits (not shown) are also provided to control the operation of the various cylinders and other devices. These circuits are similar in construction and operation to the clip setter circuits discussed in Section II above. It is believed that one skilled in the art could make and use suitable circuits with little or no experimentation. Accordingly, their description will be omitted for the sake of brevity.

B. Construction of Lift Mechanism

The lift mechanism 516 serves several functions. First, it supports the workhead(s) 518 and 520 so as to be lowerable from a raised transport position above the rails 504 and 506 to a lowered, working position in which the workheads rests upon the rails 504 and 506. (The lift mechanism 516 will be raised only for transport to and from the worksite or if the machine 500 must traverse a road or the like, and otherwise will be in its lowered position illustrated, e.g., in FIG. 16.) Second, the lift mechanism 516 maintains the workheads 518 and 520 parallel with the rails 504 and 506 even on a curve where the workheads may otherwise tend to swing out over the vertical center of gravity. Fourth, the lift mechanism 516 mounts the workheads 518 and 520 on the chassis frame 514 so as to permit the workheads 518 and 520 to move automatically, both transversely and longitudinally with respect to the rails 504 and 506, to position the workheads properly for clip application. To this end, the lift mechanism 516 preferably includes an upper support frame assembly 544, the float frame 522 on which the workheads 518 and 520 are mounted, and a drive device 586, 594 via which the float frame 522 is suspended from the support frame assembly 544 and which is operable to selectively raise and lower the float frame 522 with respect to the support frame assembly 544.

Referring especially to FIGS. 17–22, the support frame assembly 544 includes 1) an outer frame formed from a pair of longitudinally opposed end braces 548 and 2) an inner frame 550. Inner frame 550 includes longitudinal rails 552 connected to one another by transverse end braces 554. Each rail 552 is clamped between a lower V-groove wheel 556 and an upper cam roller 558 (both of which are rotatably mounted on the chassis frame 514) so as to be movable longitudinally with respect to the frame 514 and rails 504 and 506. The end braces 548 are rigidly connected to chassis frame 514 and support a first set of elastomeric bumpers 560 extending inwardly therefrom. A complimentary second set of bumpers 562 extends outwardly from each end brace 554 of the inner frame 550. A rod end of a cylinder 564 abuts each end brace 554 to nominally center the inner frame 550 with respect to the braces 548. It should be emphasized, however, that this cylinder is only a passive device because it only centers the inner frame 550 with respect to the braces 548 in the absence of the imposition of any other forces. Actual fore-to-aft movement within the range permitted by the bumpers 560 and 562 occurs under the imposition of forces arising when the backstop 610 engages the tie plate 538 as detailed below.

Transverse movement of the workheads 518 and 520 with respect to the vehicle chassis 514 and rails 504 and 506 is made possible by a linear bearing assembly permitting an outer portion of the float frame 522 to move laterally with respect to the remainder of the float frame. Specifically, referring to FIGS. 18–21, the lower end of the float frame 522 includes a pair of longitudinally opposed end blocks 566 each of which extends transversely with respect to the chassis 514. A pair of opposed braces 567 extends longitudinally inwardly from the end blocks 566 and receives the lower end of the scissor arm mechanism 586 detailed below. A pair of longitudinal plates 568, each of which receives the support deck 602 of a respective workhead 518, 520, are mounted on the end blocks 566 via linear bearings 570 which permit limited transverse movement of the plates 568 and workheads 518, 520 relative to the end blocks 566. The bearings 570 1) are slidably supported in sleeves 572 located adjacent the transverse ends of the blocks 566 and 2) present rods 574 extending into bores formed in supports 576 and 578 attached to the plates 568. Springs 580 bias the plates 568 away from the blocks 566. Specifically, each spring 580 is supported in a support tube 582 mounted on a partition 584 located at the center of the associated end block 566, and the outer end of each spring 580 cooperates with the end block 566 and the linear bearings 570 so as to bias the associated plate 568 away from the center of the end block 566.

The drive device for suspending float frame 522 from support frame assembly 544 could conceivably comprise one or more hydraulic cylinders. However, referring to FIGS. 16–19, a scissor mechanism 586 is preferred because it automatically provides a centering function not necessarily provided by other lift devices. The scissor mechanism 586 includes, at each longitudinal end of the lift mechanism 516, a scissor arm assembly formed from a pair of scissor arms 588, 590. Each scissor arm 588, 590 has an upper end pivotally mounted on the inner frame 550 of the support frame assembly 544 by a first shaft connecting the two scissor arm assemblies to one another, and a lower end pivotally mounted on the float frame 522 by a second shaft connecting the two scissor arm assemblies to one another. As is standard with such mechanisms, one end of each of the scissor arms 588, 590 is also slidably mounted in a slot 592 formed in the respective frame 522 or 550, and each end of a third shaft pivotally receives the central portion of both scissor arms 588 and 590 of a respective scissor arm assembly. Each scissor arm assembly further includes a double-acting hydraulic cylinder 594 having a rod end connected to the upper end of one scissor arm 588 and a cylinder end connected to the upper end of the other scissor arm 590.

C. Construction of Workhead

Although two workheads 518, 520 are illustrated, one could be eliminated and replaced with a guide wheel assembly or some other structure for supporting the lift mechanism 516 on the rail not subject to a clip application process. In the illustrated embodiment in which two workheads are provided, both are preferably of identical construction. Accordingly, only the workhead 518 will be described.

Workhead 518 includes a support frame 600 including a support deck 602 bolted to the longitudinal edge plate 568 of the float frame 522. A clamp assembly 604, the construction and operation of which will be detailed below, is provided at each end of the workhead 518. The workhead 518 further includes two clip applying assemblies, one of which is designed to apply clips on the outer or field side of the rail 504, and the other of which is designed to apply clips on the inner or gauge side of the rail 504. As with the clip setter machine described above, the orientations of these two assemblies are reversed with respect to one another to apply clips in opposite directions, but the construction and operation of both assemblies are identical. Accordingly, only one such assembly will be described.

Each clip applying assembly includes a magazine assembly or clip dispensing assembly 606, a clip applicator assembly 608, and a backstop 610, all of which are mounted on the support deck 602. Each of the clamp assembly 604, the magazine assembly 606, the clip applicator assembly 608, and the backstop 610 will be detailed below.

1. Clamp Assembly

Figure 24:
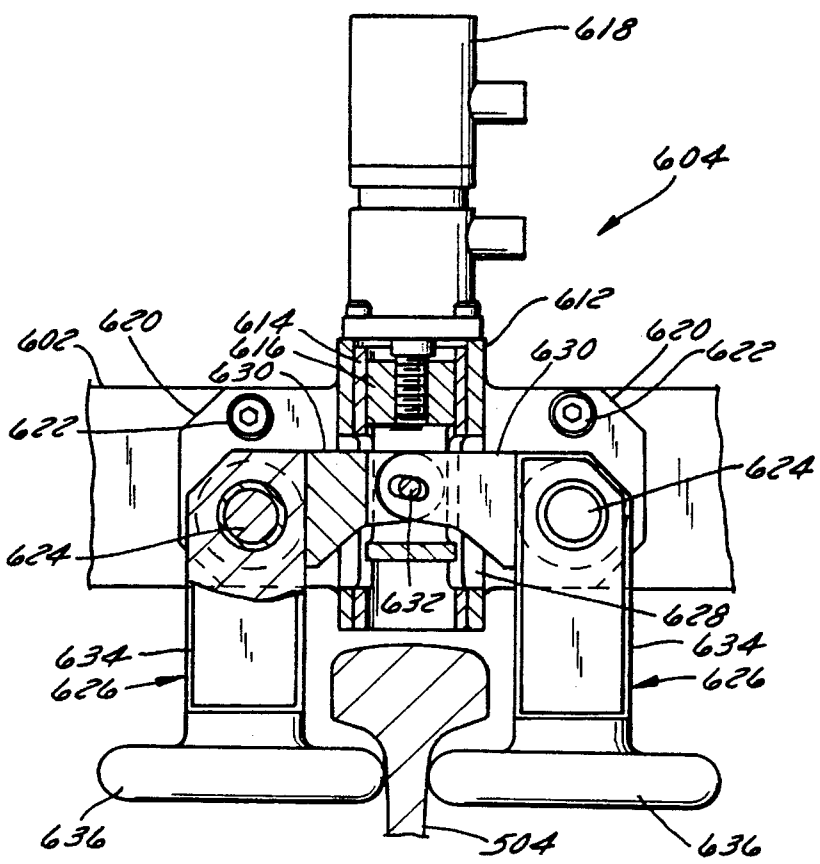
FIGS. 23 and 24 illustrate a clamp assembly of the clip applicator machine in an unclamped and clamped position, respectively.
Figure 23:
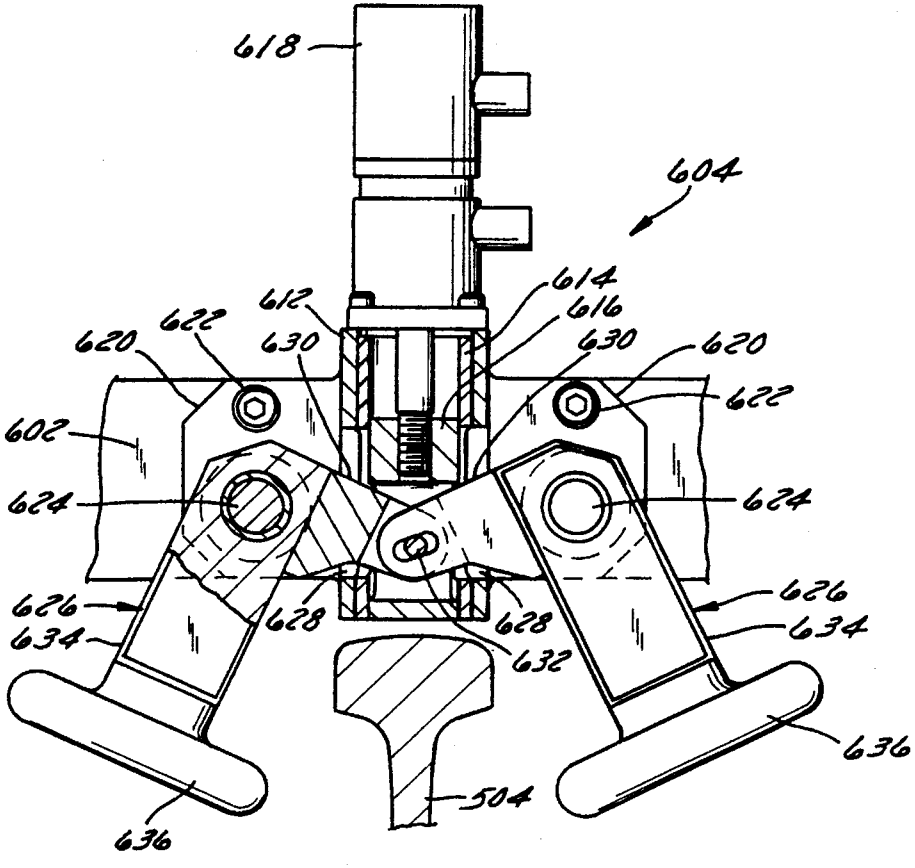
Figure 25:
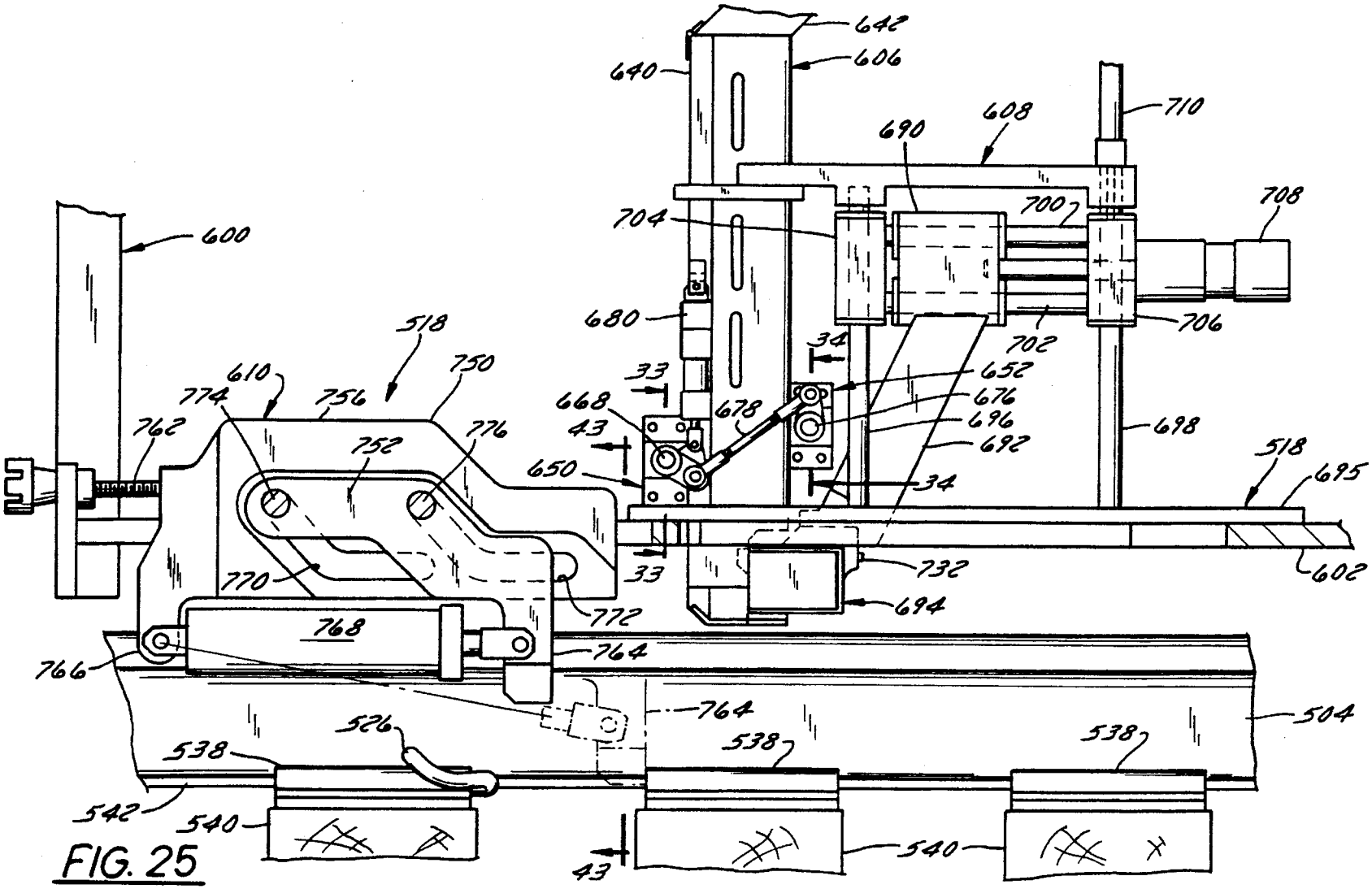
FIG. 25 is a side elevation view of a portion of the workhead of the clip applicator machine.
Figure 28:
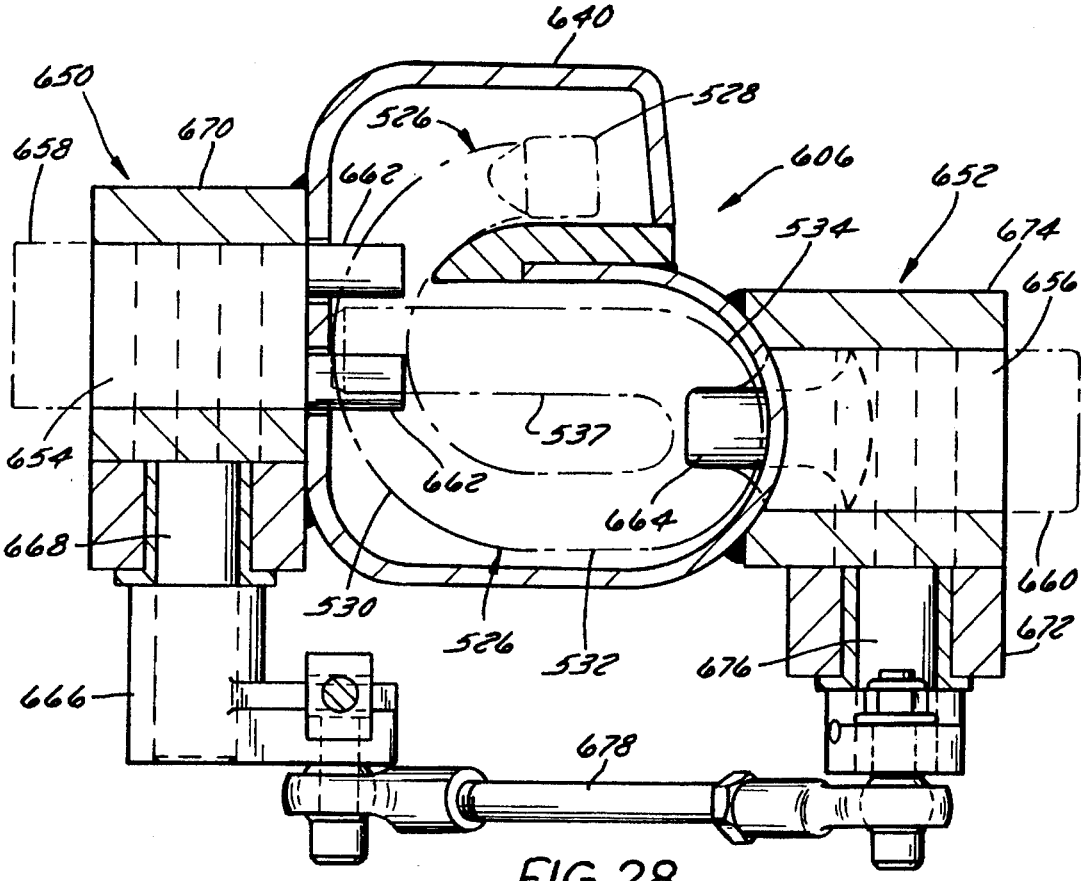
FIG. 28 is a top plan view of the magazine assembly.
Figure 26:
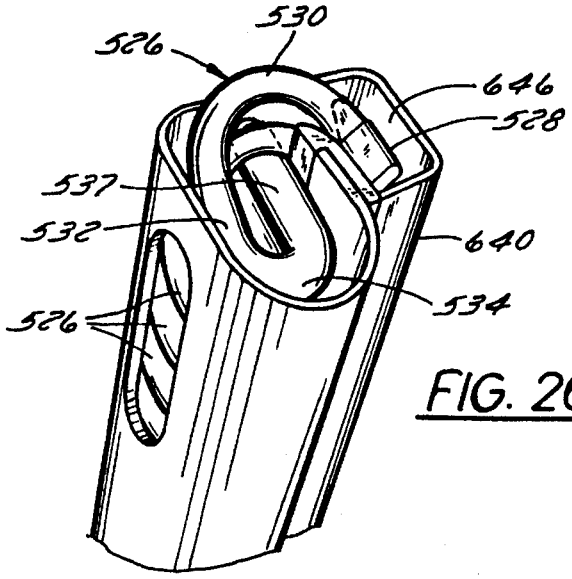
FIG. 26 is a perspective view of a portion of a magazine of the magazine assembly of the clip applicator machine.
Figure 27:
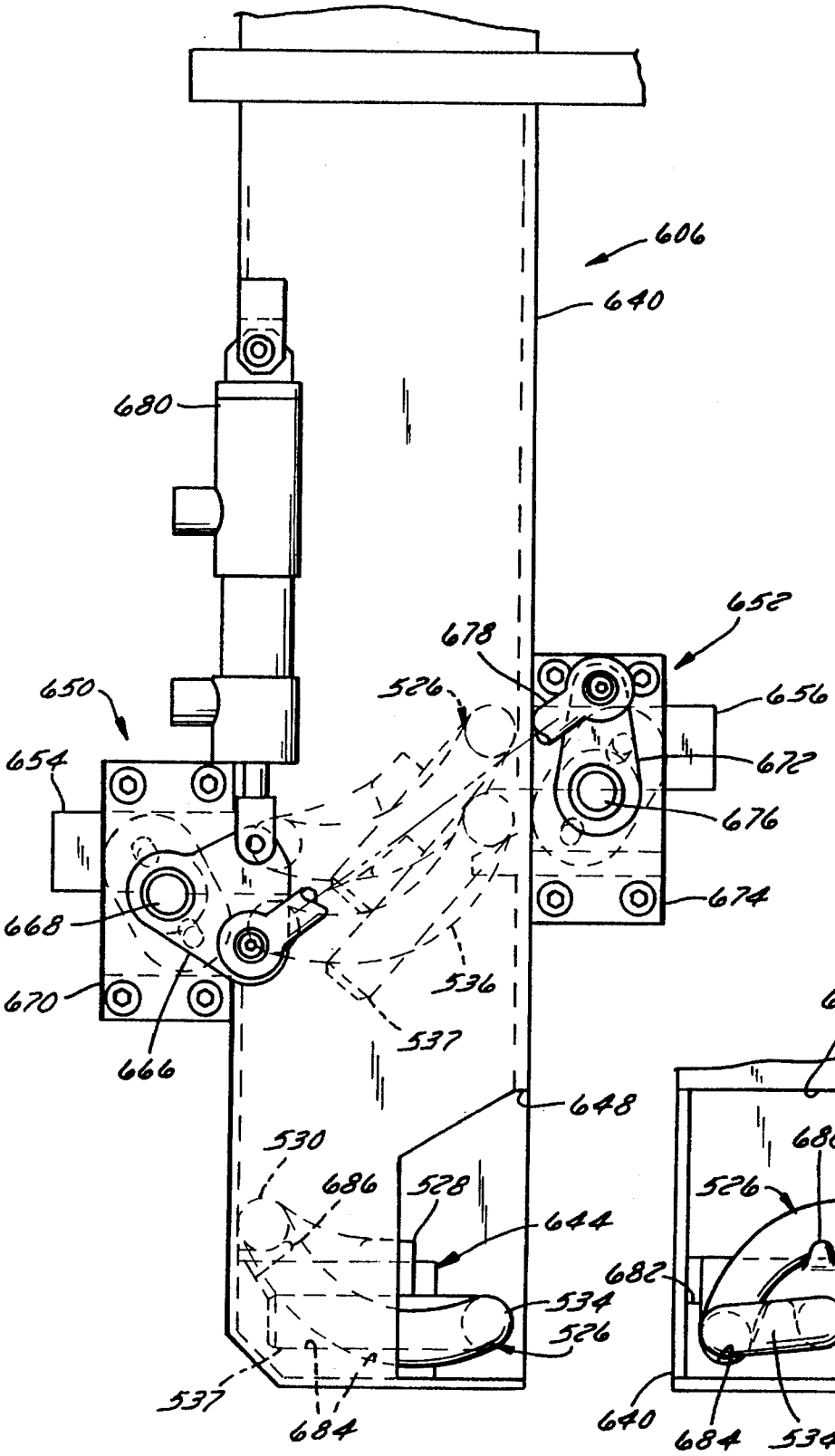
FIG. 27 is a side elevation view of the magazine assembly.
Figure 29:
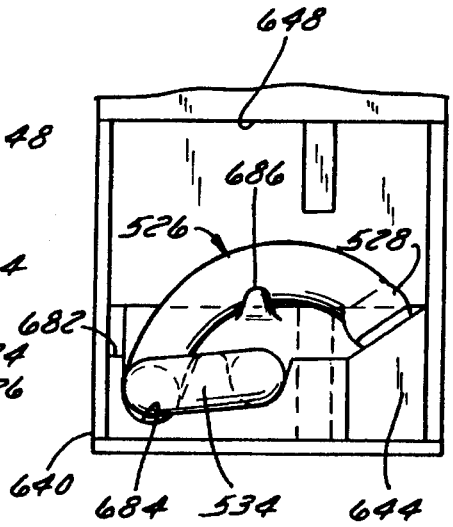
FIG. 29 is a front elevation view of the lower portion of the magazine assembly.

Referring now to FIGS. 15–17, 23, and 24, each clamp assembly 604 includes a housing 612, an inner sleeve 614 disposed in the housing 612, and a block 616 slidably disposed in the sleeve 614. A hydraulic cylinder 618 extends vertically from the housing 612 and has a rod end which extends into the housing 612 and which is attached to the block 616. Flanges 620 extend outwardly from the housing 612 and are attached to the support deck 602 by upper and lower bolts 622 and 624. The lower bolt 624 of each flange 620 also serves as a pivot shaft for an L-shaped arm 626. A slot 628 1) is formed through each of the opposed transverse sides of the housing 612 and sleeve and 2) receives a first end 630 of each arm 626. The ends 630 of both arms 626 are in turn pivotally attached to the block 616 by a common pin 632. A second end 634 of each arm 626 receives a rolling clamp roller 636 at its lower end which can be selectively pivoted away from the rail 504 as illustrated in FIG. 23 or clamped to the rail 504 as illustrated in FIG. 24 by extending or retracting cylinder 618.

The illustrated clamp assembly 604 has at least two advantages over those having independently operated clamp rollers. First, it is self-centering because the clamp rollers 636 1) are both operated by a single cylinder 618 and 2) are symmetrical about the center of the workhead 518 so that clamping the workhead 518 to the rail 504 automatically centers the workhead 518 with respect to the longitudinal center line of the rail 504. Second, the clamp assembly 604 is somewhat simpler than standard clamp assemblies because only a single cylinder 618 is required to operate both clamp rollers 636.

2. Magazine Assembly

Referring now to FIGS. 15 and 26–39, the magazine assembly or clip dispensing assembly 606 may be any assembly adapted to store clips and to selectively supply them one at a time to the corresponding clip applicator assembly 608. In the illustrated embodiment, each magazine assembly 606 comprises a magazine 640 adapted to store a stack of clips 526, a chute 642 for feeding clips 526 into the magazine 640, and an impact pad 644 positioned beneath the magazine.

The chute 642 (FIG. 15) is hinged to the upper end of the magazine 640 and positioned so that a person seated on seat 525 can retrieve clips from the hopper 527 and load all four magazine assemblies of the machine 500. A second chute (not shown) is provided for the gauge side magazine assembly and is angled in the opposite direction.

The magazine 640 preferably takes the form of an e-shaped metal tube mounted on support deck 602 and forming part of the support frame 600. The magazine 640 also has an upper inlet 646 which receives clips 526 and a lower outlet 648 from which clips are discharged. The tube is specially shaped so as to store about 15 clips 526 in a vertical stack with their rear arches 534 angled upwardly with respect to their front arches 530 so that they can move through the tube and be dispensed therefrom without jamming—a problem experienced by most previously-known magazines. A front latch block assembly 650 and a rear latch block assembly 652 are provided at the lower end of the magazine 640 and are designed to selectively dispense clips 526 one at a time from the magazine 640. The latch block assemblies 650 and 652 are spaced vertically with respect to one another such that the assembly 650 acts on the front arches 530 of the clips 526 and the assembly 652 acts on the rear arches 534.

Each of the latch block assemblies 650 and 652 includes a first or upper latch block 654 or 656 movable (a) from a first position in which it is inserted between a bottom clip 526 in the stack and the remainder of the stack and in which it supports the remainder of the stack (b) to a second position in which it is withdrawn from the stack and in which the remainder of the stack rests on the bottom clip. Each latch block assembly 650 or 652 further includes a second or lower latch block 658 or 660 which is disposed beneath the first latch block 654 or 656 and which is movable (a) from a first position in which it is inserted beneath the stack and in which it supports the bottom clip (b) to a second position in which it is withdrawn from the stack and leaves the bottom clip unsupported. Each latch block 654 and 658 of the front assembly is formed from a pair of spaced fingers 662, and each latch block 656 and 660 of the rear assembly 650 is formed from a single central finger 664.

Figure 31:
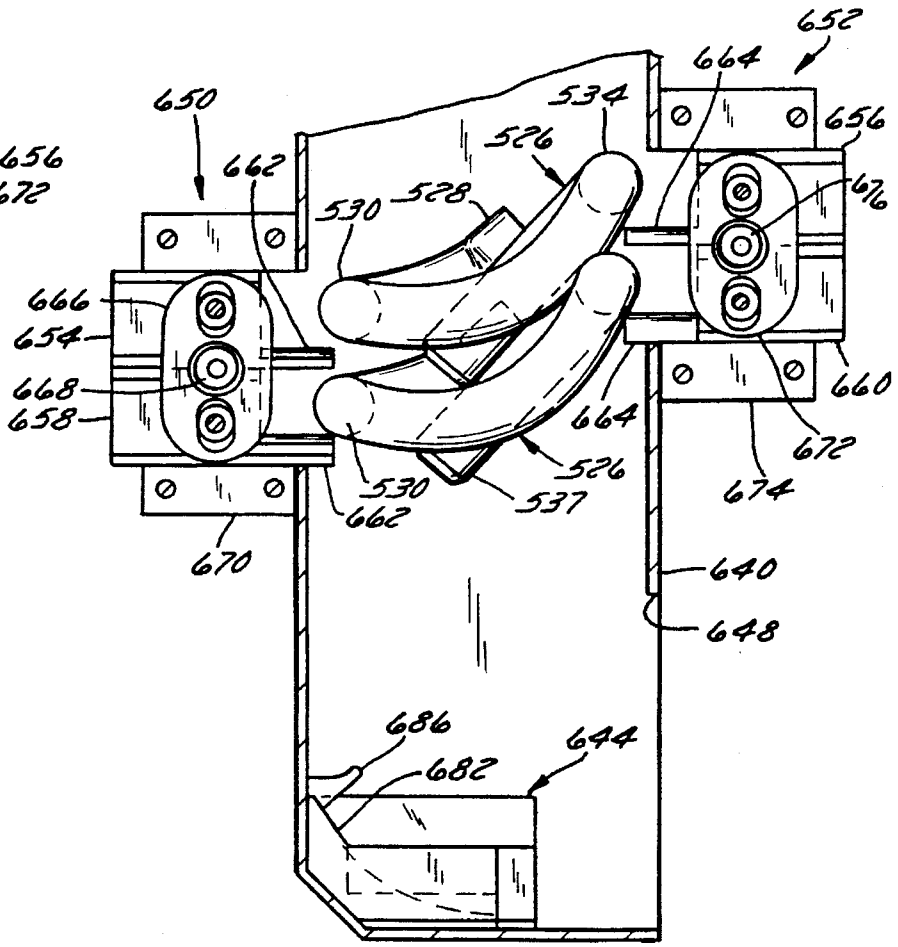
FIGS. 30–32 illustrate the dispensing of a clip from the magazine of the magazine assembly.
Figure 30:
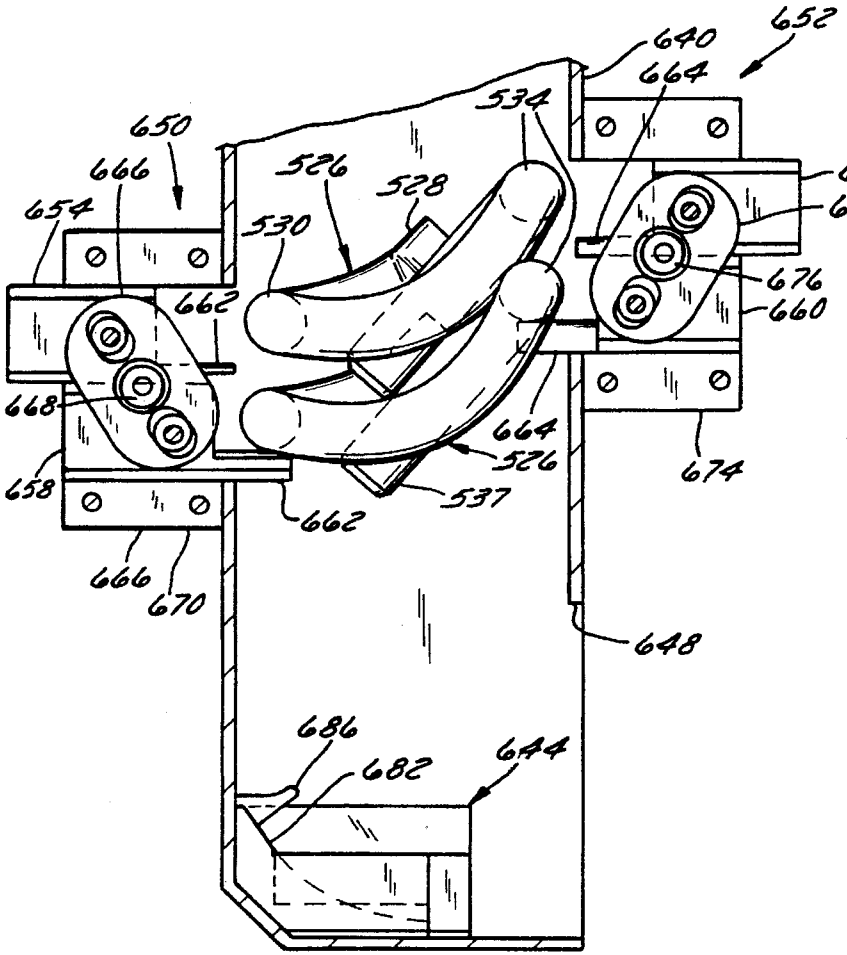
Figure 37:
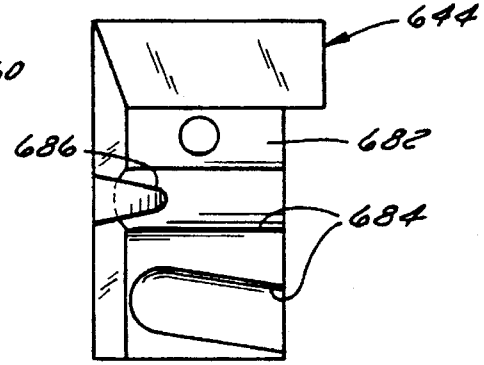
FIGS. 37–39 illustrate an impact pad of the magazine assembly from various perspectives.
Figure 38:
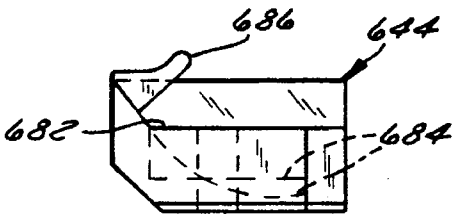
Figure 39:
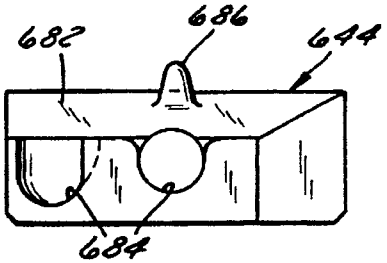
Figure 32:
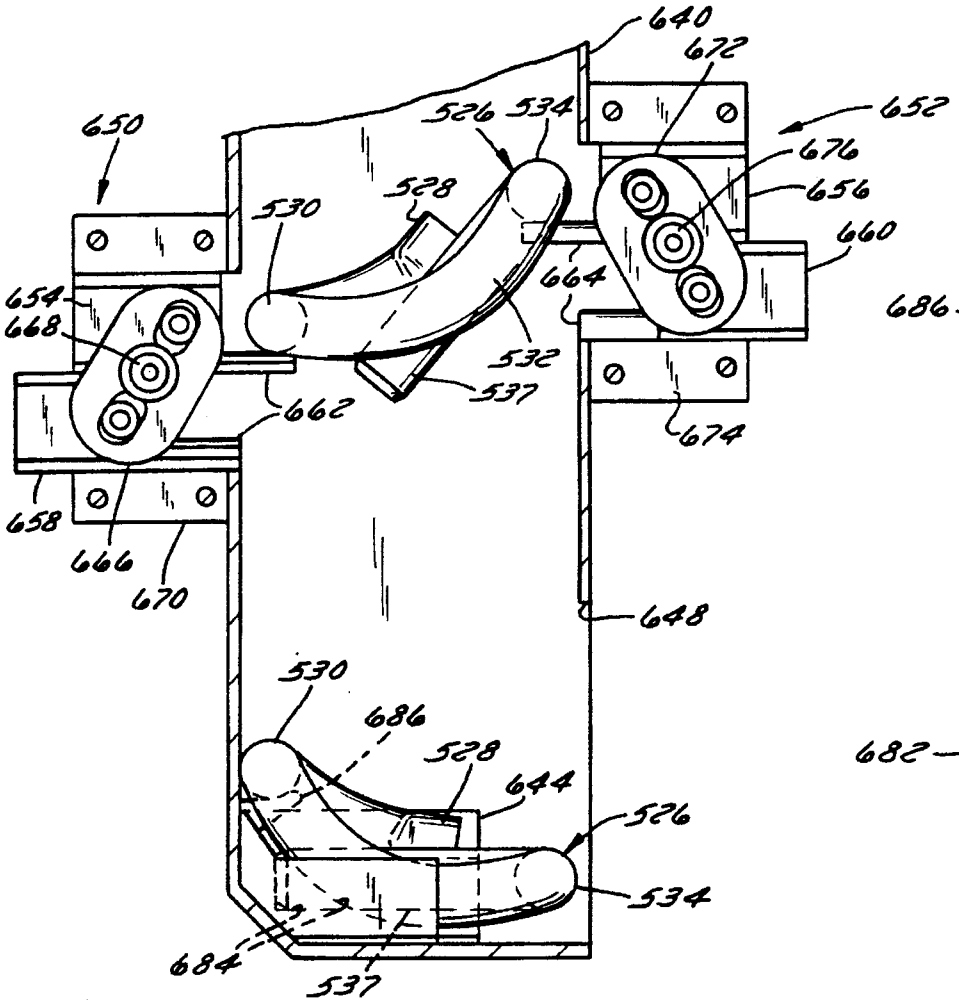
Figure 33:
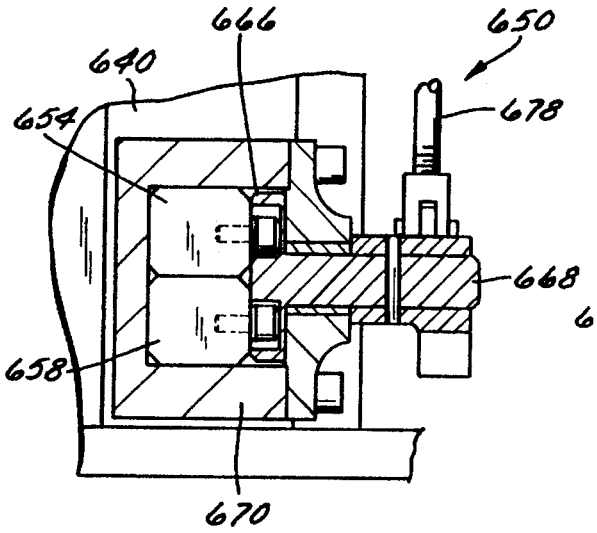
FIGS. 33 and 34 are sectional lines taken along lines 33—33 and 34—34, respectively, in FIG. 25.
Figure 34:
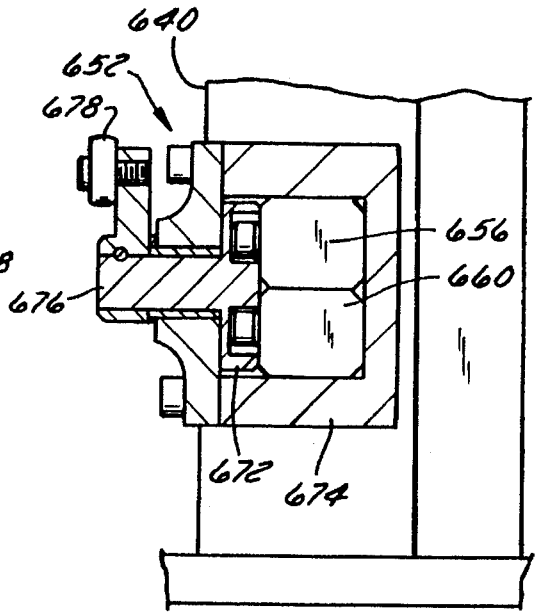
Figure 35:
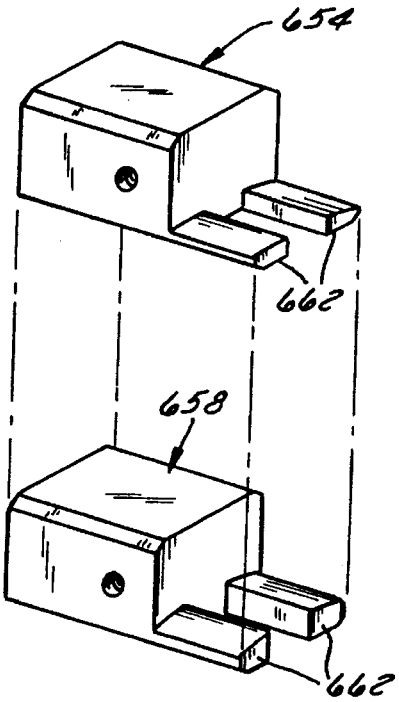
FIGS. 35 and 36 are perspective views of the latch blocks of the latch assemblies of the magazine of FIGS. 26 and 27.
Figure 36:
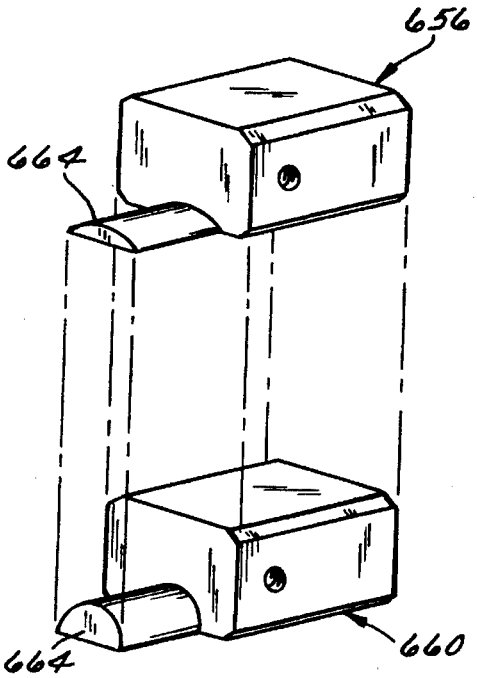

Reciprocating motion of the latch blocks 654 and 658 of the front latch block assembly 650 is effected via a drive mechanism which includes a crank assembly and a double acting cylinder 680. The crank assembly which, in the illustrated embodiment, includes a first crank arm 666. First crank arm 666 1) has an upper end pivotally connected to the upper latch block 654 and a lower end pivotally connected to the lower latch block 658 and 2) upon rotation about a central pivot pin 668, drives the latch blocks 654 and 658 to slide in opposite directions within a support 670 in which they are mounted. A second crank arm 672 has upper and lower ends connected to the latch blocks 656 and 660 of the rear latch assembly 652 in the same manner, and similarly drives the latch blocks 656 and 660 to slide in opposite directions within a support 674 in which they are mounted when it rotates about a central pivot pin 676. A rod 678 has opposed ends connected to the pivot pins 668 and 676 of the crank arms 666 and 672. The double acting cylinder 680 is connected to the crank arm 666. Extension of the cylinder 680 causes the crank arm 666 to rotate, thereby simultaneously (1) causing the fingers 662 of the upper latch block 654 to extend into a slot formed in the tube of the magazine 640 and support all the clips in the stack except for the bottom clip, and (2) causing the fingers 662 of the lower latch block 658 to withdraw from the tube. Rotation of crank arm 666 also translates the rod 678 to drive the crank arm 672 to rotate, causing the fingers 664 of its latch blocks 656 and 660 to simultaneously release the lowermost-clip and retain the remainder of the stack in place, thereby permitting the lowermost clip to fall from the magazine 640. This sequence is illustrated in FIGS. 30–32. Upon subsequent retraction of the cylinder 680, the lower latch block of each assembly 650 and 652 resumes its inserted position, and the upper latch block resumes its retracted position, thereby permitting the remaining clips in the stack to rest on the lower latch blocks 658 and 660 and readying the next clip in the stack for dispensing.

The impact pad 644 is mounted in the magazine assembly 606 beneath the outlet 648 of the magazine 640. The purpose of the impact pad 644 is to (1) receive a clip 526 as it is dispensed from the magazine 640 and, (2) to hold the clip 526 in place in a suitable position for access by the clip applying tool 694 detailed below. The impact pad 644 is mounted in the magazine assembly 606 beneath the outlet 648 of the magazine 640 and is preferably constructed from a relatively elastic material, preferably polyurethane, so as to absorb part of the impact energy from the clip 526 and to prevent it from bouncing out of the magazine assembly when it falls the several inches from the bottom outlet 648 of the magazine 640. Referring especially to FIGS. 27–31 and 37–40, an upper surface 682 of the pad 644 is orientated to position the clip 526 for access by the clip applying tool 694. A recess 684 is formed in the upper surface 682 and has a shape which complements that of the face of the clip 526 and which thus serves as a support surface for the clip 526. A protrusion or tab 686 extends upwardly from the surface 682 and retains a clip 526 on the pad 644 after it is received from the magazine 640. Tab 686 is desirable because clips tend to slide off from the inclined upper surface 682 of pad 644 when they are dispensed from the magazine 640. The tab 686 prevents the forwardly-leaning clip from falling off from the pad 644 while at the same time orienting it for access by the clip applying tool 694. This provides significant versatility in operation because there is no longer any need to time clip dispensing with the arrival of a clip applying tool at the magazine assembly 606. On the other hand, because the tab 686 is flexible, once the clip 526 is grasped by the clip applying tool 694 as discussed below, and once the clip applying tool 694 begins to pull the clip 526 away from the magazine assembly 606, the tab 686 merely deforms to permit the clip 526 to be pulled away from the magazine assembly 606.

3. Clip Applicator Assembly

The purpose of each clip applicator assembly 608 is to transport clips 526 one at a time from the magazine assembly 606 and to apply them in the anchor sockets 536 so that they are fully tensioned against the base 542 of the rail 504. To this end, referring to FIGS. 15, 25, and 46, each clip applicator assembly 608 preferably comprises a guide preferably taking the form of a guide rod assembly, a support block 690 mounted in the guide rod assembly for both horizontal and vertical movement with respect thereto, and a clip applying tool 694 suspended from the support block 690 by a support arm 692. The entire clip applicator assembly 608 is mounted on the support deck 602 via a plate 695 which is movable both longitudinally and transversely with respect to the support deck 602 for reasons detailed below.

The guide rod assembly comprises a pair of longitudinally opposed vertical guide rods 696 and 698 and a pair of vertically spaced horizontal guide rods 700 and 702. Each of the vertical guide rods 696 and 698 is affixed to the plate 695 at its lower end and extends upwardly from the support deck 602. A pair of vertical guide sleeves 704 and 706 are slidably mounted on the vertical guide rods 696 and 698 and are rigidly attached to the horizontal guide rods 700 and 702. The support block 690 is fixedly mounted on the horizontal guide rods 700 and 702 and is slidable therealong under the action of a double acting hydraulic cylinder 708 having its rod end connected to the support block 690 and its cylinder end mounted on the vertical guide sleeve 706. A second double acting hydraulic cylinder 710 is mounted on the frame 600 and has a rod end connected to the upper end of guide sleeve 706. The cylinders 708 and 710, in combination, form a drive assembly for moving the clip applying tool 694 from a first position in which it receives a clip 526 from the magazine assembly 606, through a second position in which the clip applying tool 694 positions the clip 526 adjacent the socket 536, and into a third position in which the clip applying tool 694 drives the clip 526 far enough into the socket 536 to fully tension the clip 526 against the base 542 of the rail 504. Previously known devices required the interaction of two or more automatic and/or manually controlled devices to perform these functions. The inventive clip applicator 608 performs all of these functions using a single tool.

Referring to FIGS. 40–42 and 44–47, the clip applying tool 694 includes a clip holder 712 and a clip driver 714 connected to one another so as to permit limited linear movement therebetween. The clip holder 712 1) has a pocket 716 formed therein for receiving the rear arch 534 of a clip 526 and 2) receives a pair of spring-loaded plungers 718 and 720 which are threadedly mounted in the body of the clip holder 712. Each plunger includes a retractable head 722 or 724 which extends into the pocket 716 for retaining the clip 526 in the pocket 716 while it is transported from the magazine assembly 606 to the socket 536. Plunger 718 extends downwardly and forwardly into the pocket 716 from above, and plunger 720 extends into the pocket 716 at an oblique angle from a front portion thereof. Two plungers are desired because the clip 526 should be retained in position as it rotates when it is being driven into the anchor socket 536. That is, when the clip 526 is driven into the socket 536 as discussed below, it will rotate in the direction of arrow 726 in FIG. 42 and will pull away from the head 724 of plunger 720 before it is fully inserted into the socket 536. Alignment with the socket 536 will be retained by the plunger head 722 until the clip 526 is fully inserted.

The clip driver 714 includes a body which is attached to the support arm 692 and which has a cavity formed therein which slidably receives the clip holder 712. The clip driver 714 is connected to the clip holder by a bolt 732 which is threaded into the clip holder 712 but which is freely slidable (within limits) through the body of the clip driver 714. A coil spring 734 is 1) disposed in a cavity 730 formed between an outer end surface 736 of the clip holder 712 and an inner end surface 738 of the clip driver 714, 2) surrounds the bolt 732, and 3) biases the clip holder 712 into a maximum extended position away from the clip driver 714. A ram 740 1) is fixed to the body of the clip driver 714, 2) extends into the pocket 716, 3) has a front face 742 the shape of which complements that of the clip 526, and 4) is operable, upon relative movement between the clip holder 712 and the clip driver 714, to drive the clip 526 out of the pocket 716. The stroke of the clip driver 714 relative to the clip holder 712, and thus the effective stroke of the ram 740, can be adjusted to accommodate slightly different clip configurations by adjusting a set screw 744 threaded into the body of the clip driver 714 and extending into the cavity 730.

4. Backstop

The purpose of the backstop 610 is 1) to longitudinally align the workhead 518 with the associated anchor socket 536 and 2) to hold the tie plate 538 in place during the clip application process. The backstop 610 must also be capable of moving into position without interference from adjacent ties 540. To this end, referring especially to FIGS. 25, 43 and 46, the backstop 610 includes a housing 750 and a backstop arm 752 which is movably mounted in the housing 750. The housing 750 1) is attached to the deck 602, e.g., by bolts 754 engaging a slot in the deck 602 and 2) includes a pair of opposed housing sections 756 and 758 which are bolted together and which are held in alignment with one another by dowel pins 760. The position of the housing 750 can be adjusted longitudinally with respect to the deck 602 to accommodate variations in tie plate length via operation of an adjusting screw 762 engaging the rear end of the housing. An identical adjusting screw (not shown) engages the support plate 695 for the clip applicator assembly 608. Other adjusting screws (not shown) engage the transverse edges of the support for the backstop 610 and the support plate 695 for the clip applicator assembly 608 to permit side-to-side adjustment in the direction of arrow 603 in FIG. 42 to accommodate variations in tie plate width.

Housing section 756 has a cavity formed therein for receiving the backstop arm 752. The backstop arm 752 has a downwardly-extending front end 764, and an ear mount 766 is formed on the rear end of the housing 750. A double acting hydraulic cylinder 768 has a rod end connected to the front end 764 of the backstop arm 752 and a cylinder end attached to the ear mount 766.

Cam grooves 770 and 772 are formed in housing section 756 and receive cam rollers 774 and 776 mounted on the backstop arm 752. The cam grooves 770 and 772 are horizontal at the front end thereof and are inclined at an angle of about 45 degrees at the rear end. Accordingly, upon initial extension of the cylinder 768, the front end of the backstop arm 764 will simultaneously move forwardly and downwardly, thereby dropping into position for engagement with the tie plate 538 without interference from the adjacent tie 540. Further extension of the cylinder 768 will cause the front end 764 the backstop arm 752 to move horizontally 1) to first engage the tie plate 538 and 2) then, assuming there is misalignment between the workhead 518 and the socket 536, to drive the workhead 518 longitudinally along the V-rollers 556 and cam rollers 558 (FIGS. 17 and 18) to align the workhead 518 with the socket 536. The horizontal stroke made possible by the horizontal portion of the cam grooves 770 and 772 and by the space between the bumpers 560 and 562 on the lift mechanism 516 should preferably be on the order of about three inches, thereby permitting up to six inches (three inches in either direction) of adjustment for alignment purposes.

D. Operation of Clip Applicator Machine

To prepare the clip applicator machine 500 for operation, the magazines 640 are filled with clips 526 taken from the hopper 527 by a person seated on seat 525. The operator, seated on seat 524, then retracts the cylinders 594 to extend the scissor mechanism 586 and lower the float frame 522 from the transport position illustrated in FIG. 17 to the working position illustrated in FIG. 16 in which the workheads 518 and 520 rest on top of the rails. Then, cylinders 618 are retracted to pivot the arms 626 from the position illustrated in FIG. 24 to the position illustrated in FIG. 23, thereby clamping the workheads 5 18 and 520 onto the rails 504 and 506. If the workhead 518 or 520 is not aligned with the longitudinal center line of the associated rail 504 or 506, e.g., because of slight differences in rail gauge, engagement of the rails with the clamping rollers 636 will drive the workhead 518 to move along the linear bearings 570 (FIGS. 20 and 21), thereby properly aligning the workhead with the rail. The operator then propels the vehicle chassis 502 to the location illustrated in FIGS. 15, 25 and 46 in which the workheads 518 and 520 are approximately centered over a tie 540.

As discussed above, each of the four clip applying assemblies is identical in operation. Accordingly, only the application of one clip by one assembly will be described, it being understood that the remaining assemblies function identically.

First, the cylinder 680 is extended to simultaneously insert the upper latch blocks 654 and 656 into the magazine 640 and to withdraw the lower latch blocks 658 and 660 from the magazine 640, thereby dispensing the bottom clip 526 from the stack in the magazine 640 while holding the remaining clips in the stack as illustrated in FIGS. 30–32. The clip 526 falls onto the impact pad 644, where it is held in place by tab 686 in the proper position for retrieval by the clip applying tool 694. The cylinder 680 then retracts to reinsert the lower latch blocks 658 and 660 and withdraw the upper latch block 654 and 656, thereby readying the magazine 640 for the next clip dispensing operation.

The clip applying operation can be initiated independently of the clip dispensing operation by extending the cylinder 768 1) to first lower the front end 764 of backstop arm 752 between two adjacent ties 540, and 2) to then engage the tie plate 538 to move the workhead 518 and lift mechanism 516 along the rollers 556 and 558 (within a range of several inches determined by the maximum spacing between the bumpers 560 and 562), thereby moving the workhead 518 longitudinally or fore and aft with respect to the rail 504 and placing it over the longitudinal center line of the tie 540 and thus properly positioning it for clip application.

Figure 44:
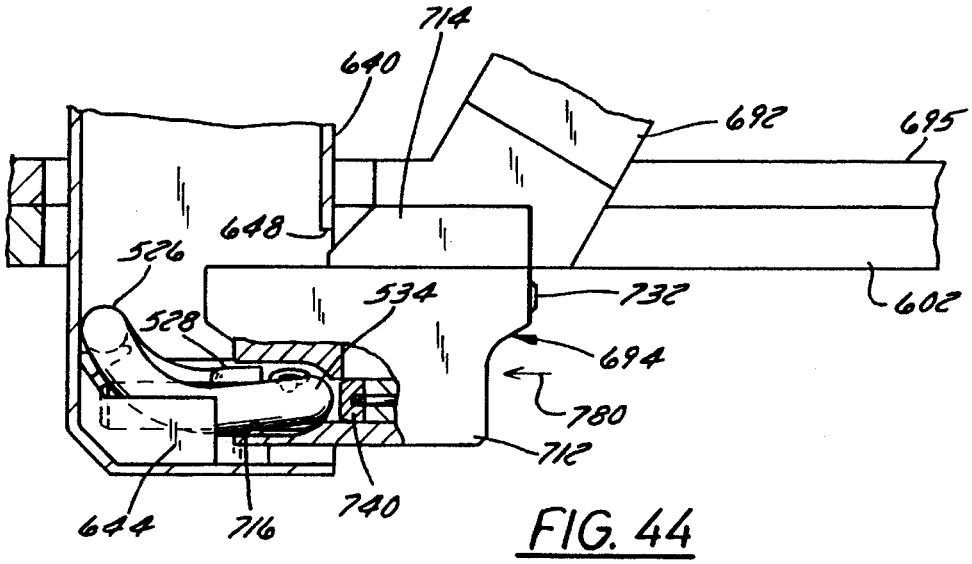
FIGS. 44–47 are partially schematic side elevation views illustrate the sequence of a clip application process.
Figure 45:
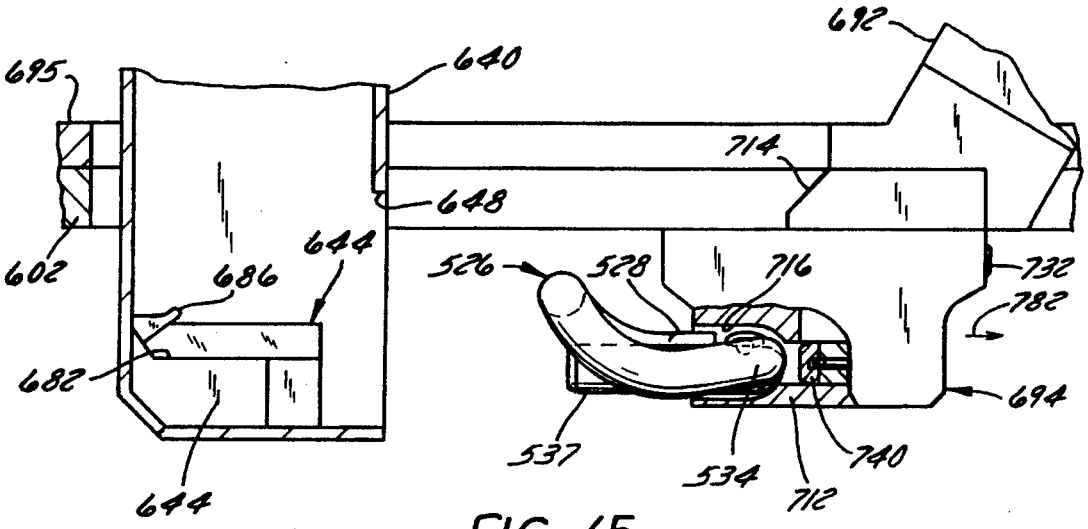
Figure 46:
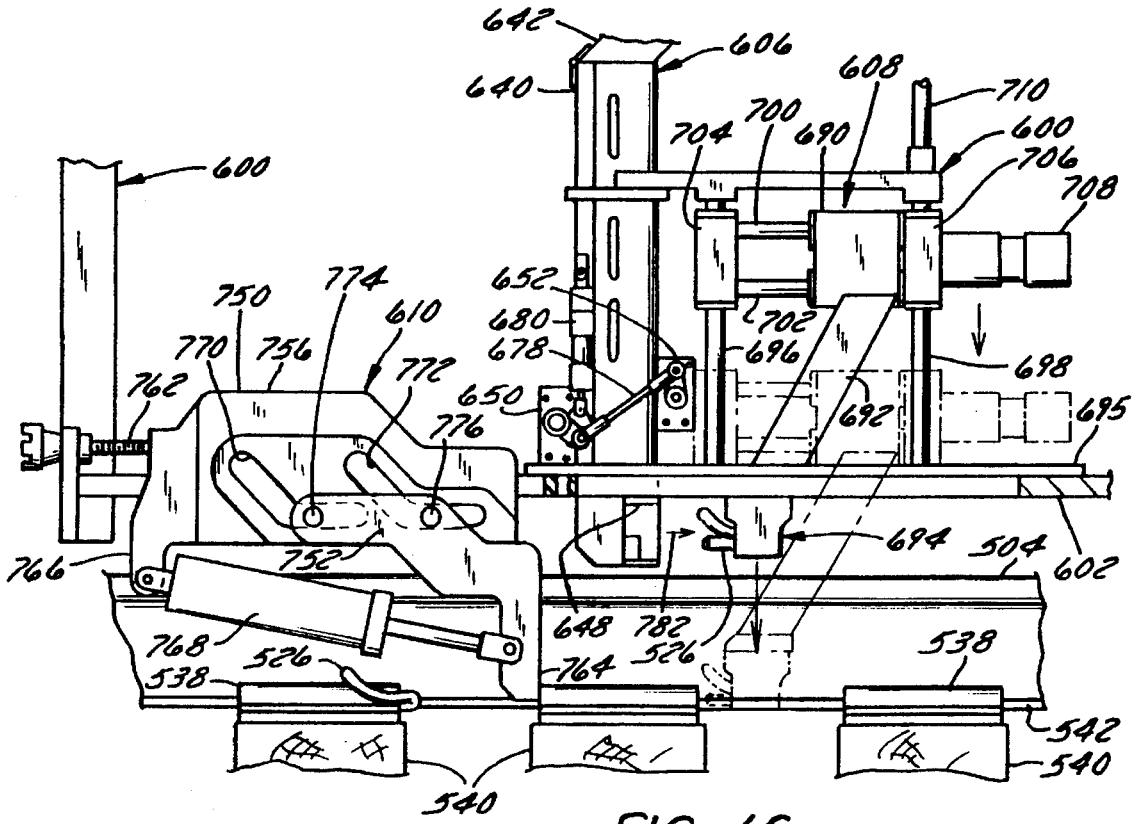

After or during operation of the backstop 610, the cylinder 708 is extended to drive the clip applying tool 694 in the direction of the arrow 780 in FIG. 44 into a position in which the rear arch 634 of the clip 526 is inserted into the pocket 716 of the clip holder 712 and held in place by the spring plungers 718 and 720. The cylinder 708 is then retracted to move the clip applying tool 694 and clip 526 in the direction of the arrow 782 in FIGS. 44 and 46, i.e., away from the magazine assembly 610. Next, the cylinder 710 is extended to drive the clip applying tool 694 downwardly in the direction of arrow 784 in FIG. 46 to a position in which the center leg 537 of the clip is in the same horizontal plane as the anchor socket 536. The clip 526 is now ready for application.

Figure 40:
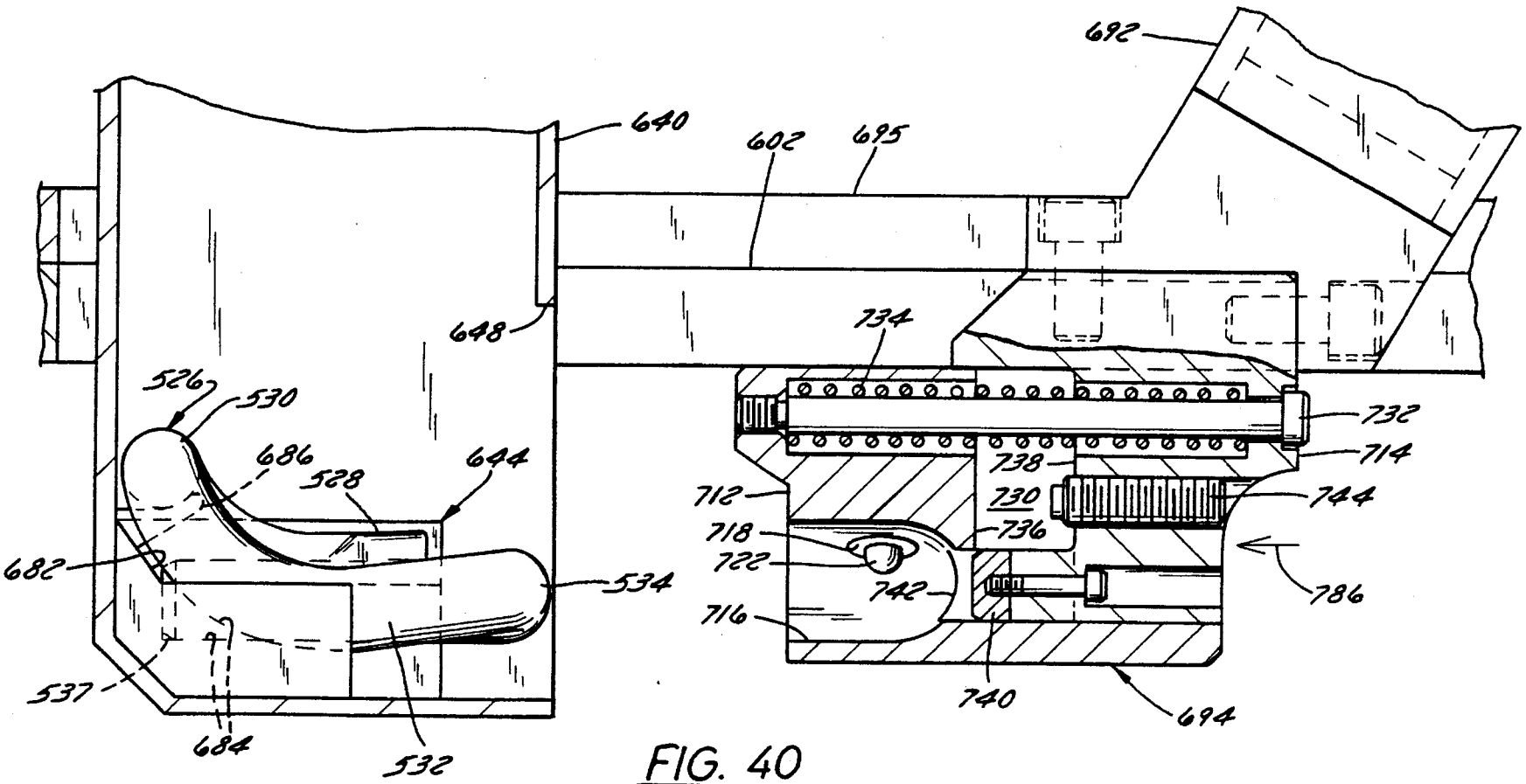
FIG. 40 is a partially cut-away side elevation view of a portion of the magazine assembly and of a clip applying tool of the clip applicator machine.
Figures 41, 42:
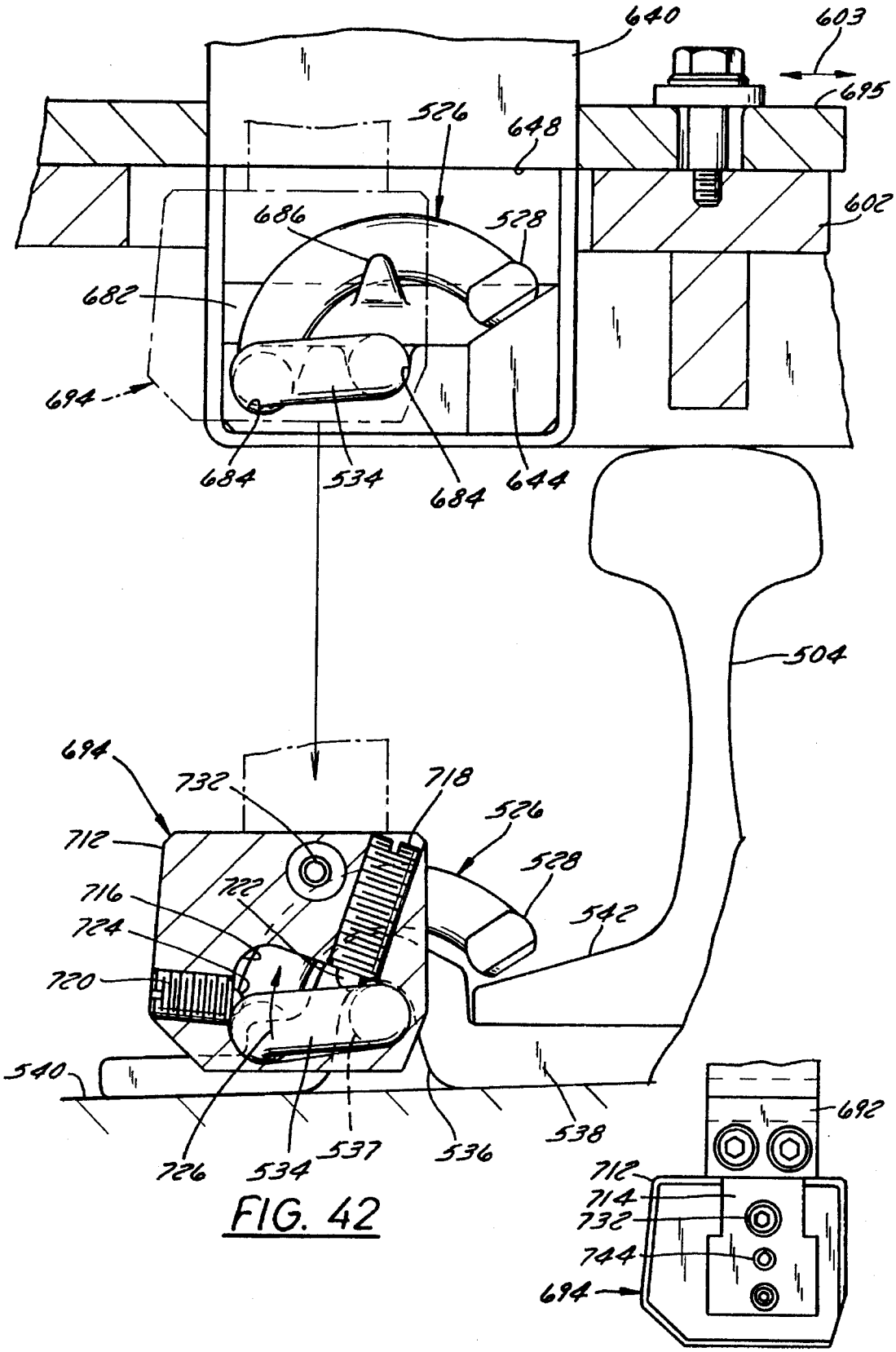
FIG. 41 is a rear end view of the clip applying tool.
FIG. 42 is a partially cut-away rear end elevation view of a portion of the magazine assembly and of the clip applying tool.
Figure 43:
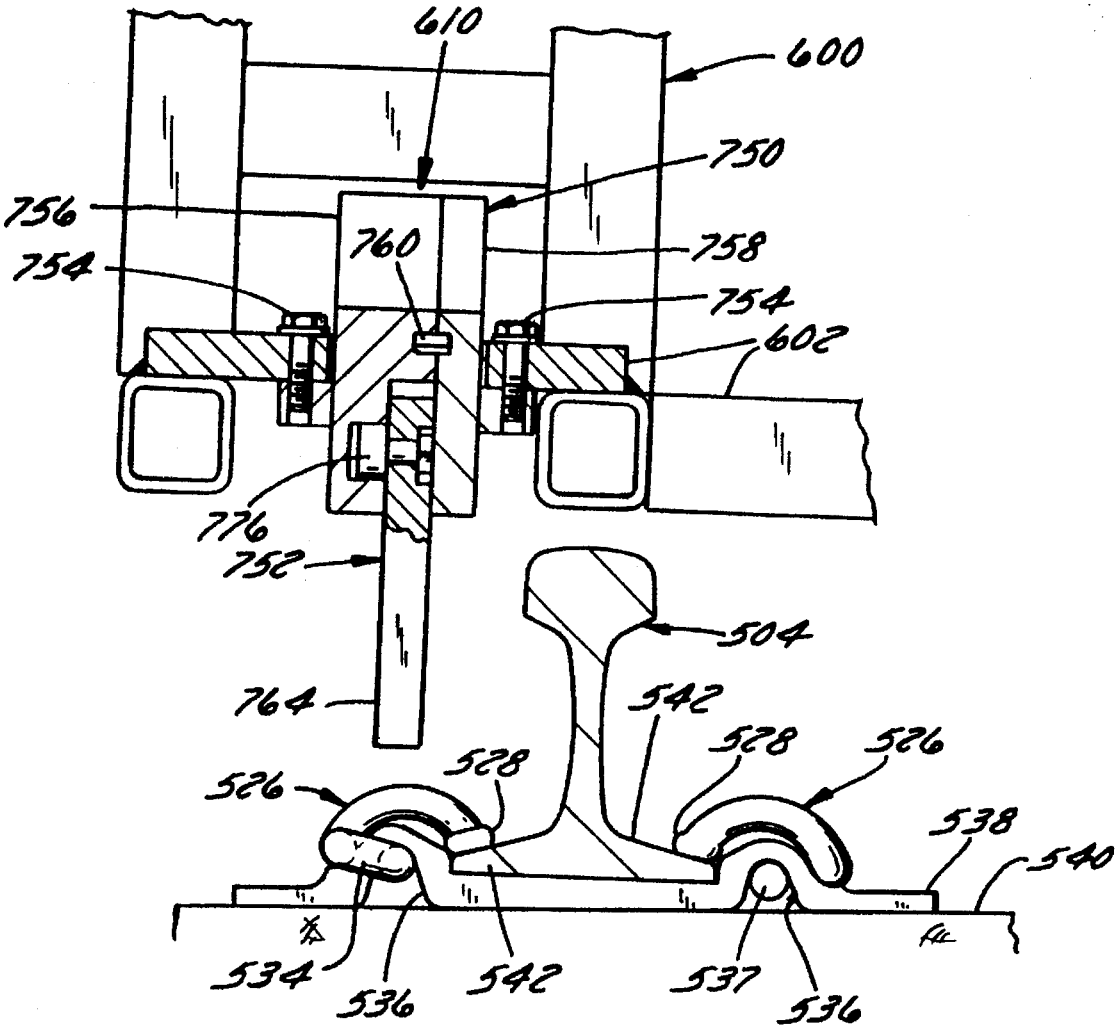
FIG. 43 is a sectional elevation view of the backstop of the clip applicator machine taken along lines 43—43 in FIG. 25.
Figure 47:
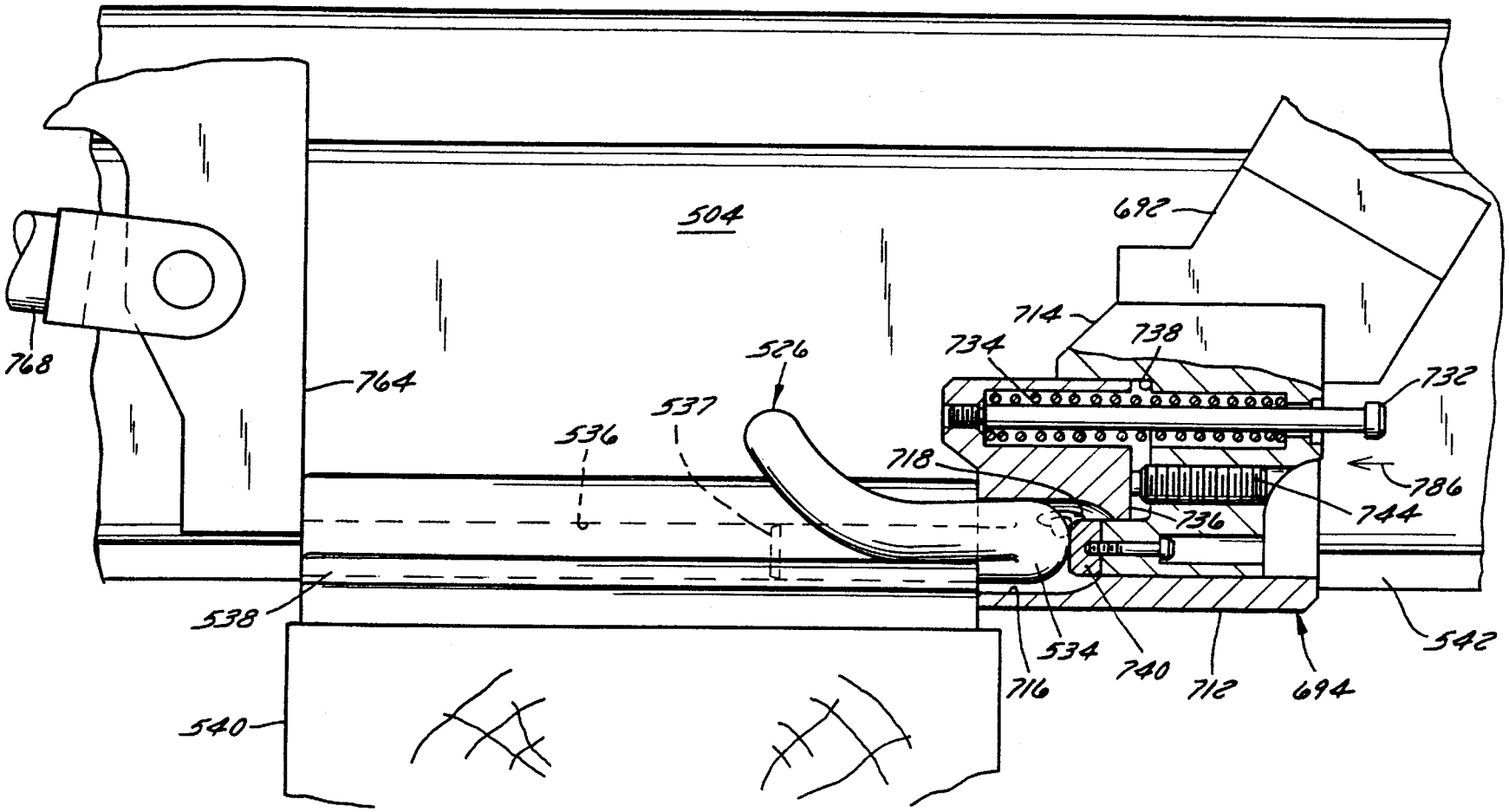

The clip application process takes place in a single continuous stroke, i.e., upon full extension of the cylinder 708 to drive clip applying tool 694 to move in the direction of arrow 786 in FIGS. 40 and 47. This single continuous stroke results in several sequential events. First, the clip holder 712 and clip driver 714 move as a unit toward the anchor socket 536 to a position in which the leg 537 of the clip 526 is inserted into the socket 536 and in which a front surface of the clip holder 712 engages the edge of the tie plate 538, thereby arresting further movement of the clip holder 712. As the cylinder 708 continues to extend, the clip driver 714 moves relative to the clip holder 712 against the biasing force of spring 734 such that the ram 740 drives the clip 526 further into the socket 536. As the leg 537 moves further into the socket 536, it rotates in the direction of the arrow 726 in FIG. 42 and becomes disengaged from the spring plunger 720. It is held in alignment with the socket 536, however, during the remainder of the applying process by the spring plunger 718. Further movement of the ram 740 drives the leg 537 of the clip 526 all the way into the socket 536, thereby fully tensioning it onto the base 542 of the rail 540 and driving the clip 526 out of engagement with the plunger 718. As discussed above, the extent of the stroke of the clip driver 714 relative to the clip holder 712 is determined by the setting of set screw 744.

After the clip 526 is applied, the cylinders 708, 710, and 768 are retracted to reset the clip applying assembly for the next clip application process. The vehicle chassis 502 is then transported to the next tie 540 in line, at which point the sequence is repeated.

It can thus be seen that the inventive clip applicator machine has considerably more versatility than other available machines. Its workhead can be aligned automatically both longitudinally and transversely with respect to the rail simply by operating the clamp assembly 604 and backstop 610. The mounting of the workhead 518 on a central lift mechanism 516 assures that the workhead will remain aligned above the rail 504 rather than swinging outwardly away from it. The magazine 640 is rather simple in construction and operation but yet reliably dispenses clips as needed. A single clip applying tool 694 is capable of receiving clips from the magazine 640, transporting them one at a time to the anchor sockets 636, and fully applying them in the sockets without requiring any separate shuttle device.

Of course, many changes and modifications could be made to the inventive clip applicator machine without departing from the spirit of the invention. The scope of these changes, some of which were discussed above, will become apparent from the dependent claims.

We claim:

1. An apparatus for applying a spring-type rail clip in an anchor socket of a tie plate, said tie plate being located on a railroad tie, and said railroad tie supporting a rail, said apparatus comprising:

(A) a movable chassis;

(B) a guide supported on said chassis;

(C) a magazine assembly which is supported on said chassis and which stores said clip;

(D) a clip applying tool which is mounted on said guide so as to be movable as a unit with respect to said guide; and (E) a drive assembly which drives the entire clip applying tool to move along said guide as a unit from a first position in which said clip applying tool receives said clip from said magazine assembly to a second position in which said clip applying tool positions said clip adjacent said socket, said drive assembly driving at least a portion of said clip applying tool into a third position in which said clip applying tool drives said clip far enough into said socket to fully tension said clip against a base of said rail.

2. An apparatus as defined in claim 1, further comprising a backstop which is supported on said chassis and which is movable from a raised, inoperative position to a lowered, operative position in which said backstop engages said tie plate, wherein, when said backstop is in said lowered position, said backstop holds said tie plate in position while said drive assembly drives at least said portion of said clip applying tool into said third position.

3. An apparatus as defined in claim 2, further comprising a lift mechanism, said lift mechanism including an upper, support frame mounted on said chassis and a lower, float frame, wherein (1) said backstop, said drive assembly, and said clip applying tool are mounted on said float frame and (2) said float frame is vertically movable with respect to said support frame and said chassis from a raised, transport position to a lowered, working position.

4. An apparatus as defined in claim 3, wherein said lift mechanism further comprises a scissor mechanism via which said float frame is suspended from said support frame, said scissor mechanism including (1) a pair of scissor arms each of which is connected to said float frame and to said support frame and (2) a hydraulic cylinder which selectively extends and retracts said scissor arms to raise and lower said float frame with respect to said support frame.

5. An apparatus as defined in claim 3, wherein said support frame includes (1) an outer frame mounted on said chassis and (2) an inner frame which is mounted on said outer frame and which is movable fore-to-aft with respect to said outer frame and said rail, wherein a portion of said float frame is movable from side-to-side with respect to the remainder of said float frame and said rail.

6. An apparatus as defined in claim 3, wherein said guide comprises a guide rod assembly which is supported on said float frame and on which said clip applying tool is mounted for vertical and horizontal movement with respect to said float frame.

7. An apparatus as defined in claim 6, wherein said guide rod assembly comprises a vertical guide rod supported on said float frame and a horizontal guide rod mounted on said vertical guide rod so as to be slidable vertically therealong, wherein said clip applying tool is mounted on said horizontal guide rod so as to be horizontally slidable therealong, and wherein said drive assembly comprises a first hydraulic cylinder which drives said horizontal guide rod to move vertically along said vertical guide rod and a second hydraulic cylinder which drives said clip applying tool to move horizontally along said horizontal guide rod.

8. An apparatus as defined in claim 2, wherein said backstop includes (1) a housing supported on said float frame, said housing having a pair of sidewalls at least one of which has a cam groove formed therein;

(2) a backstop arm mounted in said housing by cam rollers riding on said cam grooves, said backstop arm having a downwardly-depending front end for selectively engaging said tie plate; and (3) a hydraulic cylinder which is connected to said backstop arm and which selectively drives said backstop arm to move along said cam grooves from a first position in which said front end of said backstop arm is located above and behind said tie plate to a second position in which said front end of said backstop arm engages said tie plate.

9. An apparatus as defined in claim 1, wherein said clip applying tool includes (1) a clip holder having a pocket formed therein for receiving said clip; and (2) a clip driver which is connected to said clip holder but movable relative to said clip holder through a designated linear stroke, said clip driver including a ram which extends into said pocket and which is operable to apply said clip when said clip driver traverses said designated linear stroke.

10. An apparatus as defined in claim 1, wherein said magazine assembly includes (1) a magazine which stores a stack of said clips;

(2) first and second latch block assemblies disposed opposite one another on said magazine, each of said first and second latch block assemblies including (a) a first latch block movable (i) from a first position in which it is inserted between a bottom clip in said stack and the remainder of said stack and in which it supports said remainder of said stack (ii) to a second position in which it is withdrawn from said stack and in which said remainder of said stack rests on said bottom clip, and (b) a second latch block movable (i) from a first position in which it is inserted beneath said stack and in which it supports said bottom clip (ii) to a second position in which it is withdrawn from said stack and leaves said bottom clip unsupported; and (4) a drive mechanism which simultaneously (a) drives said first latch block of each of said latch block assemblies from its first position to its second position and (b) drives said second latch block of each of said latch block assemblies from its second position to its first position.

11. An apparatus for applying a spring-type rail clip in an anchor socket of a tie plate, said tie plate being located on a railroad tie, and said railroad tie supporting a rail, said apparatus comprising:

(A) a self propelled vehicle chassis having a frame;

(B) a lift mechanism mounted on said frame and including an upper, support frame and a lower, float frame mounted on said support frame for vertical movement and fore-to-aft movement with respect thereto and with respect to said rail, a portion of said float frame being movable from side-to-side with respect to the remainder of said support frame and with respect to said rail; and (C) a workhead which is mounted on said portion of said float frame and which includes (1) a support deck attached to said portion of said float frame, (2) rail clamps which are mounted on said support deck and which selectively clamp said workhead onto said rail and move said portion of said float frame and said workhead from side-to-side with respect to said rail, (3) a magazine assembly which is mounted on said support deck and which stores said clip, (4) a clip applying tool which is mounted on said support deck and which is movable from a first position in which said it receives said clip from said magazine assembly, through a second position in which is positions said clip adjacent said socket, and into a third position in which it drives said clip far enough into said socket to fully tension said clip against a base of said rail, and (5) a backstop which is mounted on said support deck and which is movable from a raised, inoperative position to a lowered, operative position in which said backstop engages said tie plate to (a) hold said tie plate in position and (b) move said float frame and said workhead fore-and-aft with respect to said rail.

12. An apparatus as defined in claim 11, wherein said lift mechanism includes a scissor mechanism via which said float frame is suspended from said support frame.

13. An apparatus as defined in claim 12, wherein said support frame of said lift mechanism includes (1) an outer frame mounted on said vehicle chassis and (2) an inner frame which is mounted on said outer frame for fore-and-aft movement with respect thereto.

14. An apparatus as defined in claim 11, further comprising a guide rod assembly which is mounted on said support deck and on which said clip applying tool is mounted for vertical and horizontal movement with respect to said support deck, wherein said clip applying tool comprises (1) a clip holder having a pocket formed therein for receiving said clip; and (2) a clip driver which is connected to said clip holder but movable relative to said clip holder through a designated linear stroke, said clip driver including a ram which extends into said pocket and which is operable to apply said clip when said clip driver traverses said designated linear stroke.

15. An apparatus as defined in claim 11, wherein said float frame is movable fore-and-aft relative to said rail under the imposition of forces generated upon engagement of said tie plate by said backstop, and wherein said portion of said float frame moves from side-to-side relative to said rail under the imposition of forces generated upon engagement of said rail by said clamp assembly.

16. An apparatus as defined in claim 15, wherein said support frame of said lift mechanism includes (1) an outer frame mounted on said vehicle chassis and (2) an inner frame which is mounted on said outer frame for fore-and-aft movement with respect thereto, and further comprising (1) rollers via which said inner frame of said support frame is supported on said outer frame for fore-and-aft movement relative thereto, and (2) bumpers which are disposed between said inner and outer flames of said support frame and which determine the maximum extent of fore-and-aft movement of said inner frame relative to said outer frame.

17. An apparatus as defined in claim 15, wherein said portion of said float frame includes a side plate, and wherein said float frame further comprises (1) a pair of longitudinally opposed transverse end blocks;

(2) linear bearings mounting said side plate on said end blocks for side-to-side movement with respect to said rail; and (3) springs biasing said side plate away from said end blocks.

18. An apparatus as defined in claim 11, wherein said clip applying tool and backstop are adjustable longitudinally and transversely with respect to said support deck so as to accommodate variations in tie plate length and tie plate width.

19. A clip applying tool for applying a spring-type rail clip in an anchor socket of a tie plate, said tie plate being located on a railroad tie, and said railroad tie supporting a rail, said clip applying tool comprising:

(A) a clip holder having a pocket formed therein for receiving said clip from a magazine assembly located remote from said socket; and (B) a clip driver on which said clip holder is mounted and which slidably receives said clip holder so as to be movable relative to said clip holder through a designated linear stroke, said clip driver including a ram which extends into said pocket and which is operable to drive said clip out of said clip holder and to apply said clip in said socket when said clip driver traverses said designated linear stroke, wherein said clip holder and said clip driver are movable as a unit, relative to said magazine assembly, from a position adjacent said magazine assembly to a position adjacent said socket.

20. A clip applying tool as defined in claim 19, further comprising a spring plunger, disposed in said clip holder and extending into said pocket, which releasably engages said clip and holds said clip in said pocket.

21. A clip applying tool as defined in claim 19, further comprising (1) a spring which biases said clip holder away from said clip driver to define a space therebetween, and (2) a set screw which extends into said space by a distance which can be adjusted to adjust said designated linear stroke.

22. A magazine assembly for holding and dispensing spring-type rail clips, said magazine assembly comprising (A) a magazine which stores a stack of said clips;

(B) first and second latch block assemblies disposed opposite one another on said magazine, each of said first and second latch block assemblies including (1) a first latch block movable (a) from a first position in which it is inserted between a bottom clip in said stack and the remainder of said stack and in which it supports said remainder of said stack (b) to a second position in which it is withdrawn from said stack and in which said remainder of said stack rests on said bottom clip, and (2) a second latch block movable (a) from a first position in which it is inserted beneath said stack and in which it supports said bottom clip (b) to a second position in which it is withdrawn from said stack and leaves said bottom clip unsupported.

23. A magazine assembly as defined in claim 22, further comprising a drive mechanism which simultaneously (a) drives said first latch block of each of said latch block assemblies from its first position to its second position and (b) drives said second latch block of each of said latch block assemblies from its second position to its first position.

24. A magazine assembly as defined in claim 23, wherein said drive mechanism comprises (A) a crank assembly attached to each of said first and second latch block assemblies and (B) a cylinder connected to said crank assembly.

25. A magazine assembly as defined in claim 22, further comprising an impact pad positioned beneath said magazine, said impact pad having a recess in an upper surface thereof, said recess having a shape generally complementing that of said clip, wherein a resilient tab extends upwardly from said impact pad, said tab normally preventing clips from falling off said impact pad but resiliently deforming to permit clips to be removed from said impact pad.

26. A backstop for holding a tie plate in position while a clip applying tool applies a spring-type rail clip in an anchor socket of said tie plate, said tie plate being located on a railroad tie, and said railroad tie supporting a rail, said backstop comprising:

(A) a housing having a pair of sidewalls of which at least one has a cam device formed therein;

(B) a backstop arm mounted in said housing by said cam device, said backstop arm having a downwardly-depending front end for selectively engaging said tie plate; and (C) a drive device which is connected to said backstop arm and which selectively drives said backstop arm to move along said cam device from a first position in which said front end of said backstop arm is located above and behind said tie plate to a second position in which said front end of said backstop arm engages said tie plate.

27. A backstop as defined in claim 26, wherein said cam device comprises (A) cam grooves formed in one of said sidewalls of said housing and (B) cam rollers mounted on said backstop arm and riding in said cam grooves.

28. A method of applying a spring-type rail clip in an anchor socket of a tie plate, said tie plate being located on a railroad tie, and said railroad tie supporting a rail, said method comprising:

(A) feeding said clip from a magazine assembly to a clip applying tool, said clip applying tool comprising 1) a clip holder which receives said clip from said magazine assembly and 2) a clip driver which is movable relative to said clip holder;

(B) moving the entire clip applying tool and said clip as a unit, relative to said magazine assembly, from a position adjacent said magazine assembly into horizontal alignment with said socket; and then (C) moving at least said clip driver of said clip applying tool and said clip toward said socket so as to first set said clip in said socket and then fully tension said clip onto a base of said rail.

29. A method as defined in claim 28, further comprising holding said tie plate in position, using a retractable backstop, during said step (C).

30. A method as defined in claim 28, wherein said clip comprises a bottom clip of a stack of clips stored in a magazine of said magazine assembly, and wherein said step (A) comprises (1) permitting said clip to fall out of said magazine while holding the remaining clips of said stack in place, and then (2) grasping said clip with said clip holder of said clip applying tool.

31. A method as defined in claim 28, wherein said step (B) comprises (1) moving said clip applying tool and said clip horizontally away from said magazine assembly, and then (2) lowering said clip applying tool vertically to a position in which said clip is horizontally aligned with said socket.

32. A method as defined in claim 28, wherein said step (C) comprises driving said clip applying tool horizontally to a position in which said clip holder of said clip applying tool abuts said tie plate and said clip is inserted into said socket, and then driving said clip driver of said clip applying tool horizontally to drive said clip out of said clip holder and to fully tension said clip onto said base of said rail.

33. A method of applying a spring-type rail clip in an anchor socket of a tie plate, said tie plate being located on a railroad tie, and said railroad tie supporting a rail, said method comprising:

(A) positioning a vehicle chassis at a location in which a workhead thereof is located over said tie, said workhead being mounted on a frame, said workhead supporting a pair of transversely opposed clamps, a clip applying tool, a magazine, and a backstop, said clip applying tool comprising 1) a clip holder which receives said clip from said magazine and 2) a clip applicator which is movable relative to said clip holder;

(B) engaging said rail with said clamps thereby to clamp said workhead to said rail and to move said workhead and at least a portion of said frame transversely with respect to said rail to a position in which said clip applying tool is in longitudinal alignment with said socket;

(C) lowering said backstop into engagement with said tie plate thereby to hold said tie plate in position and to move said workhead and said frame longitudinally with respect to said rail to a position in which said clip applying tool is properly positioned to apply said clip;

(D) dispensing a clip from said magazine into said clip holder of said clip applicator;

(D) moving the entire clip applying tool as a unit from a first position in which said clip is positioned above said socket to a second position in which said clip applying tool positions said clip adjacent said socket; and then (E) moving at least said clip applicator of said clip applying tool into a position in which said clip applying tool drives said clip far enough into said socket to fully tension said clip against a base of said rail.

34. A method as defined in claim 33, wherein said frame comprises a float frame of a lift mechanism mounted on said chassis, said lift mechanism further including an upper, support frame mounted on said chassis and a support structure via which said float frame is suspended from said support frame for vertical movement with respect thereto, and further comprising, prior to said step (A), lowering said float frame and said workhead from a raised, transport position to a lowered, working position.

* * * * *